United States Patent [19]

Kohlenbrenner

[11] Patent Number: 4,919,122

[45] Date of Patent: Apr. 24, 1990

[54] ELEMENT STRUCTURE AND PROCESS FOR ASSEMBLING SAME

[76] Inventor: Siegmar Kohlenbrenner, Im Wiedenberg 25, 7321 Ottenbach, Fed. Rep. of Germany

[21] Appl. No.: 296,836

[22] Filed: Jan. 13, 1989

Related U.S. Application Data

[63] Continuation of Ser. No. 11,466, Feb. 5, 1987, abandoned.

[30] Foreign Application Priority Data

Feb. 2, 1986 [DE] Fed. Rep. of Germany ..... 3603419

[51] Int. Cl.[5] ..... F24C 15/00; E04B 1/00

[52] U.S. Cl. ..... 126/98; 126/58; 126/114; 126/119; 52/227; 52/741

[58] Field of Search ..... 126/58, 64, 98, 114, 126/119; 52/227, 228, 229, 741; 110/336

[56] References Cited

U.S. PATENT DOCUMENTS

| | | | |
|---|---|---|---|
| 407,003 | 7/1889 | Elterich | 126/64 |
| 1,385,606 | 7/1921 | Christensen | 52/227 |
| 1,724,284 | 8/1929 | Imshenetsky et al. | 52/228 |
| 1,791,656 | 2/1931 | Brancart | 52/228 |
| 2,971,295 | 2/1961 | Reynolds | 52/228 |
| 3,369,334 | 2/1968 | Berg | 52/227 |
| 3,621,626 | 11/1971 | Tylius | 52/227 |
| 3,952,468 | 4/1976 | Soum | 52/227 |
| 3,962,088 | 6/1976 | Kulenschmidt et al. | 52/228 |
| 4,059,931 | 11/1977 | Morgan | 52/227 |
| 4,428,174 | 1/1984 | Grady, II | 52/227 |
| 4,466,420 | 8/1984 | Ernisse et al. | 126/114 |
| 4,741,135 | 5/1988 | Baena | 52/227 |

FOREIGN PATENT DOCUMENTS

| | | | |
|---|---|---|---|
| 404364 | 10/1924 | Fed. Rep. of Germany | 126/64 |
| 404365 | 10/1924 | Fed. Rep. of Germany | 126/64 |
| 3014556 | 10/1981 | Fed. Rep. of Germany | 126/64 |
| 7565 | of 1897 | United Kingdom | 403/43 |

*Primary Examiner*—Larry Jones

*Attorney, Agent, or Firm*—Foley & Lardner, Schwartz, Jeffery, Schwaab, Mack, Blumenthal & Evans

[57] ABSTRACT

Element structures are assembled from separately formed modular elements. Incorporated in the modular elements are stressing members, for example, connecting rods or the like, which can be aligned when the modular elements are positioned for installation. The adjacent connecting rods are secured to a coupling by means of which the rods can be tensioned and the entire assembly braced and rigidified. Tensile or compressive forces, due to elongation and shrinkage, are transmitted to and absorbed by the stressing members. The separate modular elements can be easily assembled or disassembled. The element structure has numerous uses, for example, in prefabricated wall or ceiling construction, in the manufacture of tiled stoves, and the like.

30 Claims, 31 Drawing Sheets

59
58

60
12
61

60
63
12
65
61
64

60
61

68
66
70
57
67
69
55
56

68
69

11
57
55
56

72
74
76
77
75
73

72
78
73
78

ELEMENT STRUCTURE AND PROCESS FOR ASSEMBLING SAME

This application is a continuation of application Ser. No. 011,466, filed Feb. 5, 1987 now abandoned.

BACKGROUND OF THE INVENTION

The invention relates to a process for the assembly and/or disassembly of an element structure, in particular a wall and/or a ceiling structure, and the element structure itself.

In the case of such an element structure, which can be used for the production of a tiled stove, e.g., the modular elements are braced with one another by stressing tendons, which are connected to one another by means of couplings. The modular elements installed in the assembled part of the element structure are only drawn into the installation position when the bracing operation takes place.

SUMMARY OF THE INVENTION

The invention is based on the object of designing a common process and element structure comprised of modular elements in such a way that the modular elements can be simply installed and braced, or disassembled even where there is no space available for shifting of the modular elements to be installed or to be disassembled.

In the case of the process according to the invention, the modular elements first have stressing tendons passed through them. The modular elements with the stressing tendons passing through them are then brought into their final installation position and connected to the neighboring modular elements by means of the couplings. This bracing operation can take place without the installed modular element and/or the already assembled part of the element structure having to be shifted. As a result, at least one of the modular elements can be used as a final element of the element structure because this modular element with the fitted stressing tendon can be installed directly in the remaining opening of the element structure. The stressing tendons and the couplings of the modular elements form a continuous tensioning device, which is designed in such a way that, when there is a tensile and/or elongational stress on one of the modular elements, the tensile forces and/or the shrinkage forces are transmitted exclusively via the stressing tendons. The modular elements themselves do not participate in this transmission of the corresponding forces. Any modular element can be dismantled from the element structure, eg. for repair purposes or for replacement. All that has to be done is to detach the bracing to the neighboring modular elements; then it can be pulled out of the element structure without any difficulty.

Further features of the invention emerge from the further claims, the description and the drawings.

BRIEF DESCRIPTION OF THE APPLICATION DRAWINGS

The invention will be explained in more detail below with reference to a number of embodiments represented in the drawings, in which:

FIG. 1 shows, in perspective representation, an inventive wall structure designed as a tiled stove, FIG. 2 shows a rear view of a modular element of the tiled stove, FIG. 3 shows a side view of the modular element according to FIG. 2, FIG. 4 shows a side view of a further modular element of the tiled stove, FIG. 5 shows a rear view of the modular element according to FIG. 4, FIG. 6 shows a bottom view of the modular element according to FIG. 4, FIG. 7 shows the detail A in FIG. 4, in enlarged representation, FIG. 8 shows a rear view of a modular element of the tiled stove forming a corner element, FIG. 9 is a view looking in the direction of the bottom of the element shown in FIG. 8, FIGS. 10 to 17 each show sections along the lines X—X to XVII—XVII in FIG. 8, FIG. 18 shows a rear view of a modular element of the tiled stove forming a cover element, FIG. 19 shows a side view of the modular element according to FIG. 18, FIG. 20 shows a view in the direction of the arrow XX in FIG. 19, FIG. 21 shows, in perspective representation, the corner region of the modular element according to FIG. 18, FIG. 22 shows a side view of a modular element of the tiled stove designed as base arch, FIG. 23 shows a front view of the modular element according to FIG. 22, FIG. 24 shows a front view of a modular element of the tiled stove designed as base part, FIG. 25 shows a side view of the modular element according to FIG. 24, FIG. 26 shows a bottom view of a modular element of the tiled stove designed as cover plate, FIG. 27 shows a side view of the modular element according to FIG. 26, FIG. 28 shows, in enlarged representation and in section, the connection of stressing tendons of neighboring modular elements, FIG. 29 shows a number of cover plates, connected to one another by means of the stressing tendons, which form a cover of the tiled stove, with part of the figure being broken away to show interior construction, FIG. 30 shows the bearing of a cover plate on a shoulder of a modular element in upright arrangement, FIG. 31 shows a tiled stove in perspective representation, FIGS. 32 to 34 show sections along the lines XXXII—XXXII to XXXIV—XXXIV, respectively, in FIG. 31, FIG. 35 shows, partially in section and partially in elevation, the rear of a modular unit, FIG. 36 shows a view in the direction of the arrow XXXVI in FIG. 35, FIG. 37 shows a view in the direction of the arrow XXXVII in FIG. 36, FIG. 38 shows, partially in section and partially in view, the rear of a further embodiment of a modular unit with a cast-on cornice, FIG. 39 shows a view in the direction of the arrow IXL in FIG. 38, FIG. 40 shows a view in the direction of the arrow XL in FIG. 39, FIG. 41 shows, in perspective representation, a further embodiment of a modular unit, FIG. 42 shows, in diagrammatic view, a building facade which can be made up from the modular units according to FIGS. 35 to 41 combined to form modular elements, FIG. 43 shows a further wall structure which can be assembled from the modular units according to FIGS. 35 to 41 combined to form modular elements, FIG. 44 shows a bracing of neighboring modular units, FIG. 45 shows, in perspective representation, a tiled stove assembled from the modular units according to FIGS. 35 to 41 combined to form modular elements, FIG. 46 shows the modular units of the tiled stove according to FIG. 45 in dismantled state, FIG. 47 shows a corner tiled stove which is made up of various modular units which are represented individually, FIG. 48 shows a longitudinal section through three pretensioned modular units placed vertically one on top of the other, which form a modular element, FIG. 49 shows, in a longitudinal section, a modular unit designed as base, with a bottom part of the vertical bracing, FIG. 50 shows, in a vertical section, a tiled stove made up of the modular elements and designed as a combined basic and convection stove, FIG. 51 shows a horizontal section through the tiled stove according to FIG. 50.

DETAILED DESCRIPTION OF THE PREFERRED EMBODIMENTS

Figure 1:
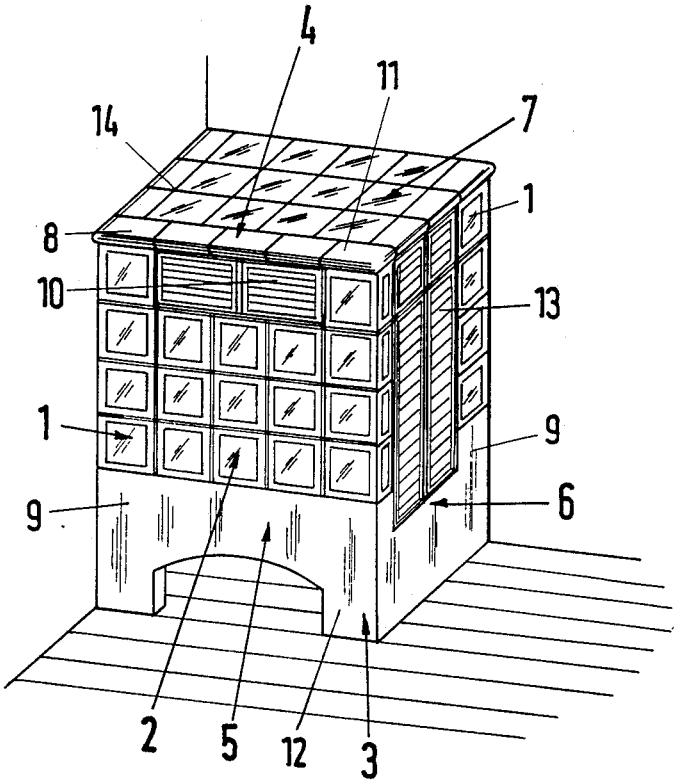

The element structure is explained in more detail below with reference to a tiled stove The tiled stove represented in FIG. 1 has been created from various modular elements 1 to 7. The modular element 1 is a four-tiled element with an upper cornice 8 and a base part 9. In the exemplary embodiment, the modular elements 1 are provided at the edges of the tiled stove each adjoining a wall. The modular elements 2 are of three-tiled design. In the exemplary embodiment, they are mounted above the base arch 5, which forms a further modular element of the tiled stove. A pipe door 10 is provided above the three-tiled modular elements 2 and is arranged directly underneath the upper cornice. The modular element 3 is a four-tiled corner element, and likewise has an upper cornice 11 and a base part 12. For producing the cornice lintel 4, it is likewise possible to use individual cornice lintel parts, which are connected to one another in a way still to be described. In the exemplary embodiment, these individual cornice lintel parts are provided in the region above the pipe door 10. Arranged between the base parts 9 and 12 of the modular elements 1 and 3 is the base arch 5, which likewise forms a modular element, which is fitted between the modular elements 1 and 3. As a further modular element, a front door base 6 is provided, which in the exemplary embodiment is arranged between the base parts 12 and 9 of the modular elements 3 and 1 below a front door 13. Finally, the tiled stove has a cover 14, which is formed from individual cover plates 7 and the cornice parts 8, 4.

Figure 2:
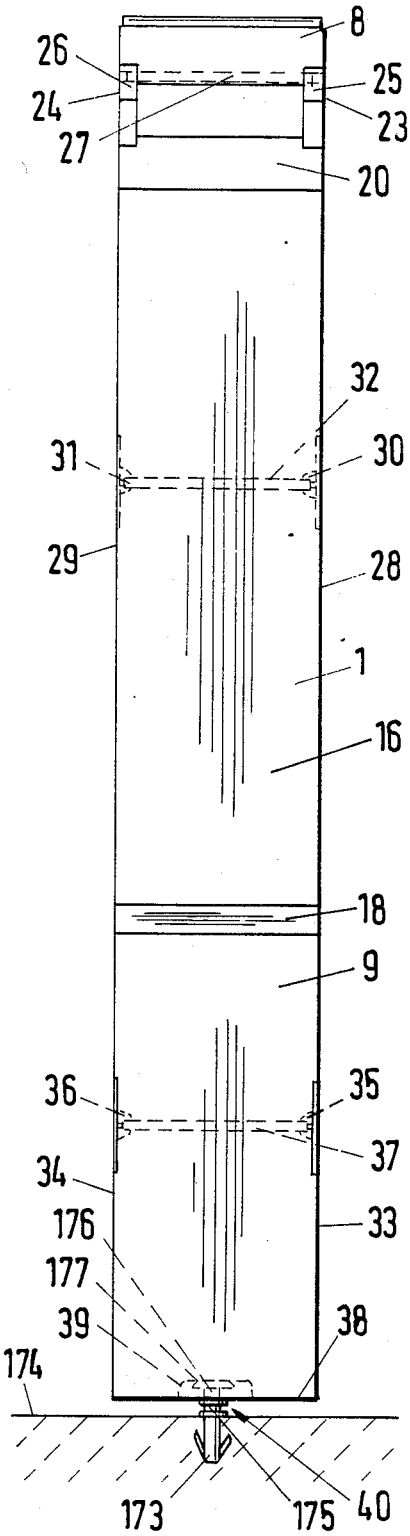
Figure 3:
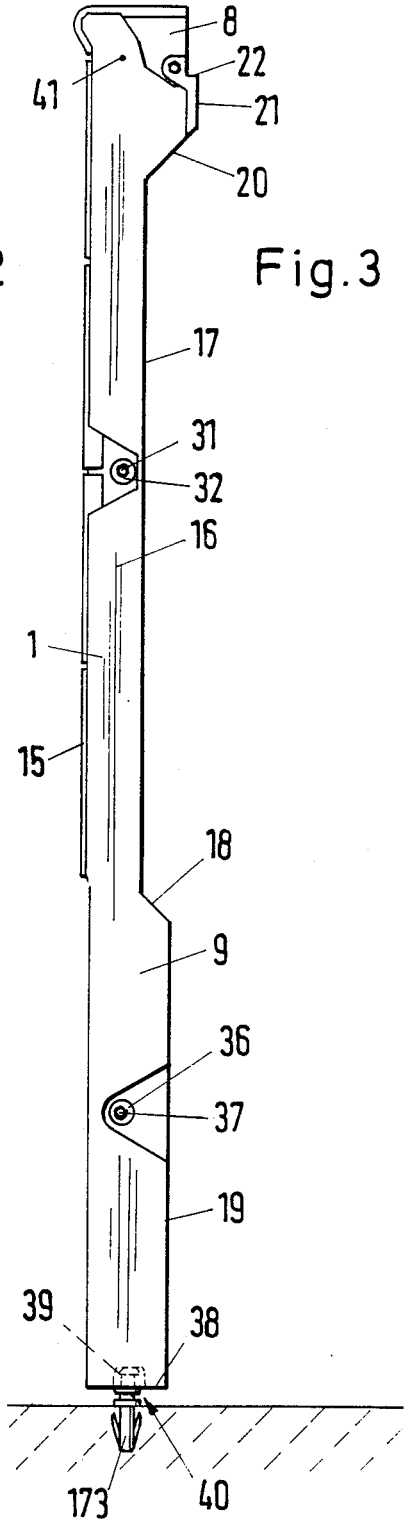
Figure 4:
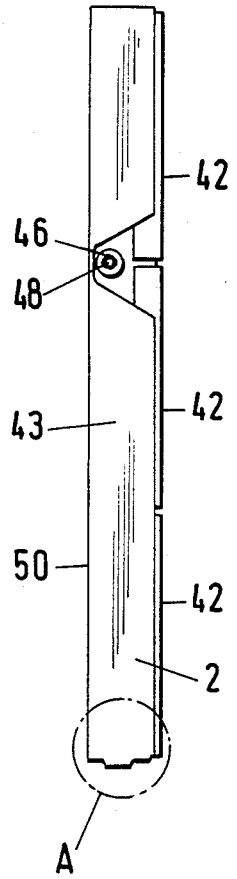

The four-tiled modular element 1 is represented in detail in FIGS. 2 and 3. Its outer side 15 is formed by four tiles one on top of the other, which lie in a series one above the other forming joints, and are fixed on a supporting section 16 consisting for example of concrete. It is designed in one piece with the base part 9, which is thicker than the supporting section 16, but has the same width. The upper cornice 8 is also designed in one piece with the supporting section 16 and has the same width. As FIG. 3 shows, the upper cornice 8 is, however, thicker than the supporting section 16 and the base part 9. At the level of the lower edge of the bottom tile 15, the rear 17 of the supporting section 16 is jointed to the rear 19 of the base part 9 via an inclined surface 18. At about half the height of the top tile, the rear 17 of the supporting section 16 runs into the rear 21 of the upper cornice 8 via a further inclined surface 20. The rear 21 is provided with a shoulder 22, at the level of which there is, on both sides 23 and 24 of the upper cornice 8, a depression 25 and 26. It is open towards the rear 21 of the upper cornice 8 (FIG. 2). Protruding into each of the depressions 25, 26 is one end of a tie rod 27, which passes through the upper cornice 8 close to its rear 21 at the level of the shoulder 22.

In each of the sides 28 and 29 of the supporting section 16, in the region between the second and third tile 15, there is a further depression 30 and 31 provided, which is also open toward the front 15 or toward the rear 17 of the supporting section 16. In each of these depressions 30, 31 lies one end of a further tie rod 32, which passes through the supporting section 16, in the region between the second and third tiles, close to the rear 17.

The sides 33 and 34 of the base part 9 are also provided with depressions 35 and 36, which are open not only toward the corresponding sides 33, 34 but also toward the rear 19 of the base part 9. In each of these depressions 35, 36 lies one end of a tie rod 37 passing through the base part.

In the center of the lower face 38 of the base part 9 there is a depression 39 in which, in the installation position, there lies an adjustment element 40, with which a vertical adjustment of the respective modular element is possible. The adjustment elements 40 are anchored in the ground support 174 by means of dowels 173 and have a nut part 175, which is seated on the ground and into which a screw 176 is screwed. This has a head 177, which bears against the bottom of the depression 39. A simple vertical adjustment of the modular element is possible by screwing the screw 176 in or out.

In each of the sides 23 and 24 of the modular element 1 there is a depression 41 provided, which serves to accommodate pegs, guidepins and the like to be able to align the cornice lintel with the modular element 1.

The modular element 1 can, of course, also be designed without the upper cornice 8 and the base part 9, as will be explained below for the modular element 2, with reference to FIGS. 4 to 7. In this case, the upper cornice 8 and the base part 9 are separate modular elements which are connected to the tile elements 1.

The modular elements 2 (FIGS. 4 to 7) has three tiles 42 arranged one on top of the other in a series and forming its outside. In the same way as with the modular element 1, the tiles 42 are arranged one on top of the other forming narrow joints. They are likewise mounted on a supporting section 43, which preferably consists of concrete. In each of the sides 44 and 45 of the supporting section 43 there is a respective depression 46 and 47, in which again one end of a tie rod 48 passing through the supporting section 43 lies in each case. The depressions 46, 47 are of the same design as the depressions 30, 31 of the modular element 1 (FIGS. 2 and 3). The upper, flat face 49 of the modular element 2 has, at half its thickness, two narrow depressions 51 and 52, running parallel to the outer side 42 and to the rear 50 of the supporting section 43, which depressions extend up to the sides 44 and 45 of the supporting section 43 (FIG. 6) and are spaced apart.

Figure 5:
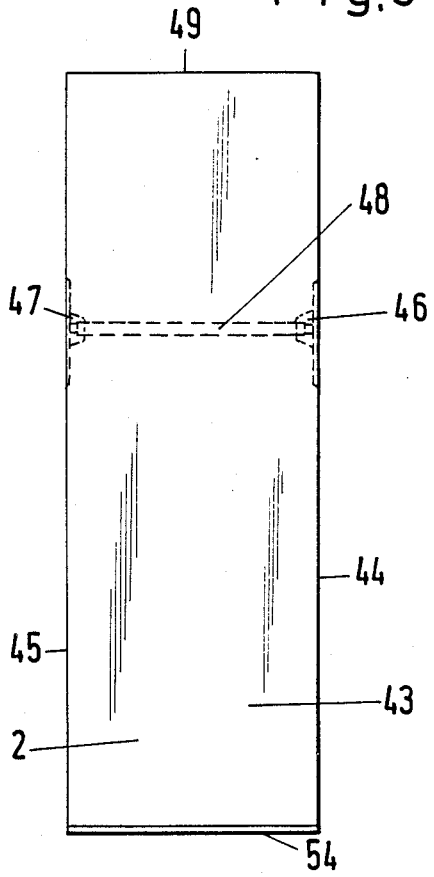
Figure 7:
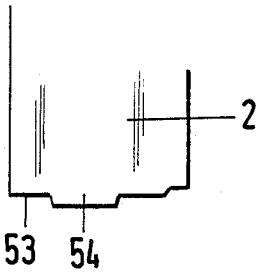
Figure 6:
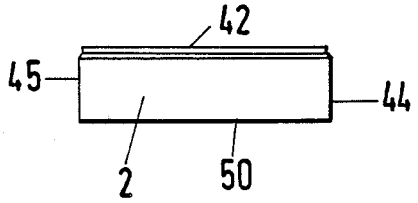

The lower face 53 of the supporting section 43 has a projection 54 lying at about half the thickness of the supporting section (FIGS. 4 and 7) and extending over the entire width of the supporting section 43 (FIG. 5). This projection 54 serves as an interlocking element, which when the tiled stove is assembled, engages in a corresponding depression of a neighboring modular element, in the exemplary embodiment a depression in the base arch 5. It is, of course, also possible to have a flat design of the lower face 53 of the modular element 2.

Figure 8:
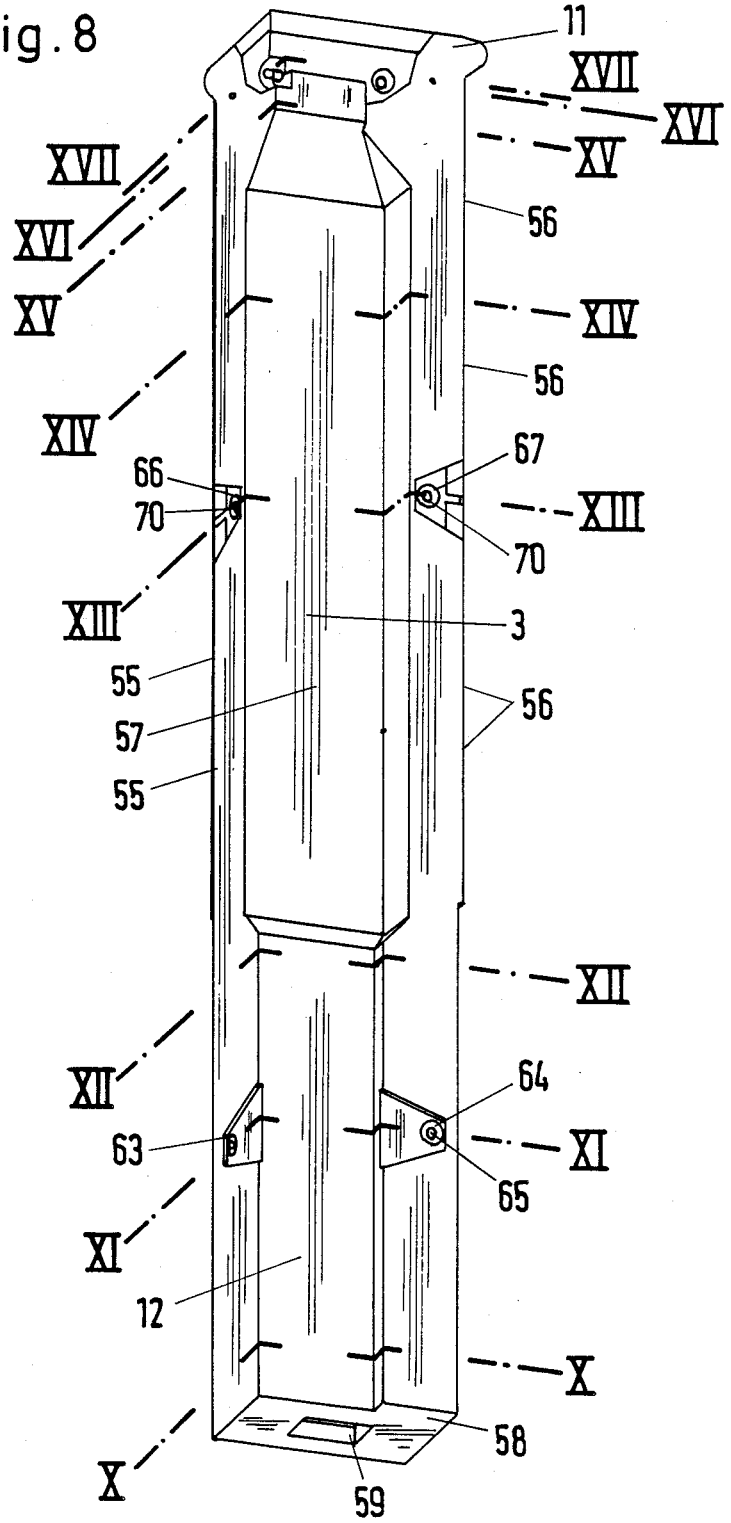
Figures 9, 10, 11, 12, 13, 14, 15, 16, 17:
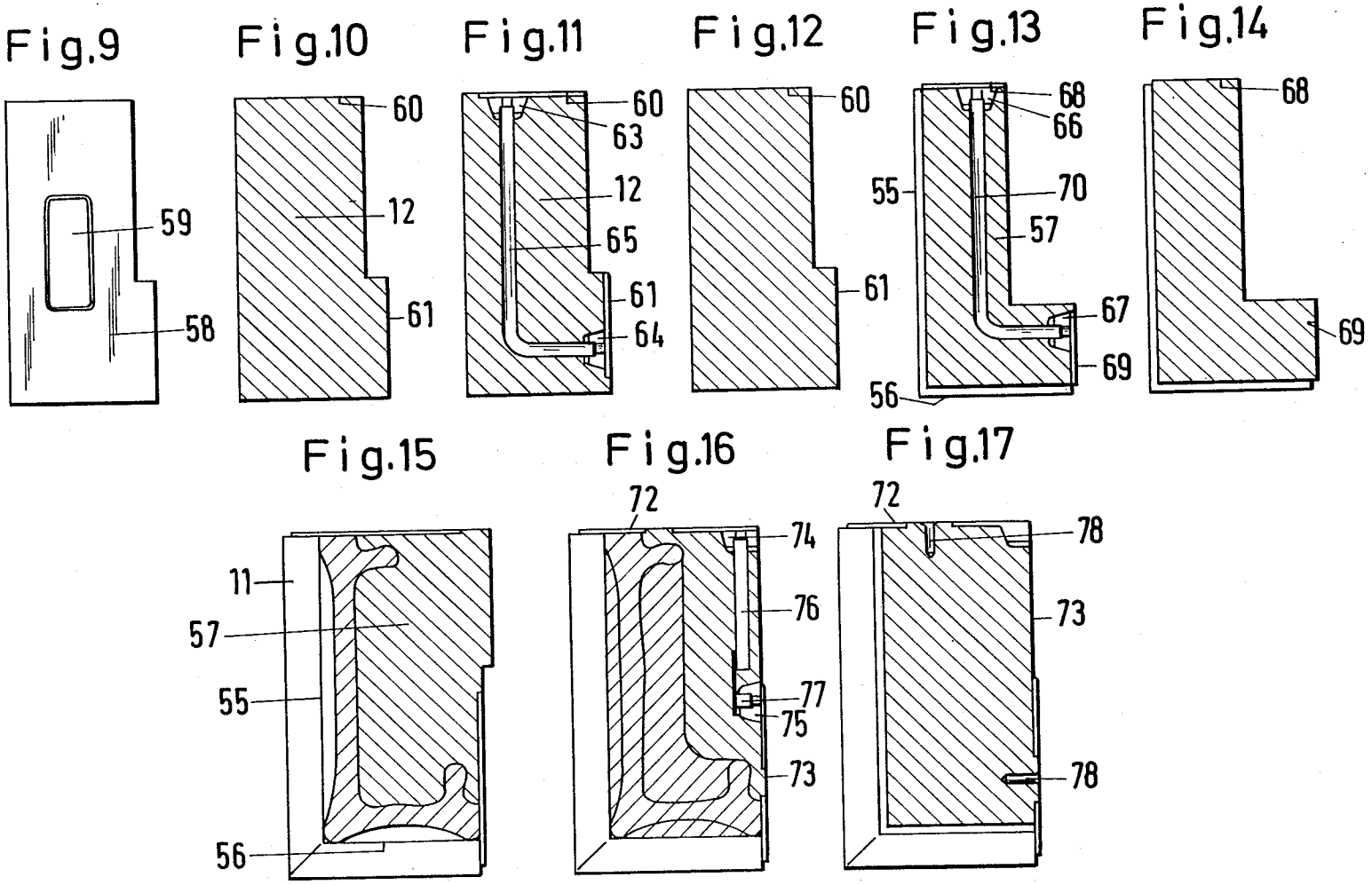

The modular element 3 serving as corner element (FIGS. 8 to 17) has, on two outer sides lying at right angles to each other, four tiles 55 and 56 arranged one on top of the other, which are fixed on a supporting section 57, which preferably consists of concrete. The tiles 55 and 56 may also be designed in one piece with one another. The supporting section 57 is designed in one piece with the base part 12, which has an approximately L-shaped outline (FIGS. 9 to 12). In the center of the lower face 58 of the base part 12 there is a depression 59 in which, when the tiled stove is assembled, the adjustment element 40 (FIGS. 2 and 3) for vertical adjustment of the modular element 3 can be accommodated. To the side areas 60, 61, neighboring modular elements are attached by their corresponding side areas. In the region between the depressions 62 lying in line one on top of the other there is in each of the side areas 60, 61 a depression 63 and 64 provided (FIGS. 8 and 11), in which one end of a tie rod 65 lies in each case. It passes through the base part 12 and runs in the shape of an L (FIG. 11).

Similar depressions 66 and 67 are also provided in the side areas 68 and 69 of the supporting section 57 (FIG. 13), which run in line with the side areas 60, 61 of the base part 12. The depressions 66 and 67 are of the same design as the depressions 63, 64 in the base part 12 and the depressions 30, 31 and 46, 47 of the modular elements 1 and 2. In the depressions 66, 67 lie the ends of a rod 70 which is bent in the shape of an L and passes through the supporting section 57. Just like the base part 12, the supporting section 57 has an L-shaped outline, but is of narrower design than the base part.

The supporting section 57 is designed in one piece with the upper cornice 11, which protrudes beyond the squarely abutting outer sides 55 and 56 (FIGS. 15 to 17). The longer outer side 55 adjoins at right angles the side area 68 and the shorter outer side 56 adjoins the right angles the side area 69 of the supporting section 57 (FIG. 13). At each of two side areas 72 and 73 lying at right angles to each other and adjoining the cornice sides at right angles (FIG. 16), the upper cornice 11 is provided with a depression 74 and 75 in which the end of a tie rod 76 and of a bolt 77 lying perpendicular to it lies. Finally, the upper cornice 11 is provided with insert openings 78 in the side areas 72 and 73 (FIG. 17), which serve to accommodate guidepins, by means of which the cornice lintel can be aligned with the neighboring modular element. As FIGS. 16 and 17 show, the depression 74 is also open toward the faces 73.

Figure 19:
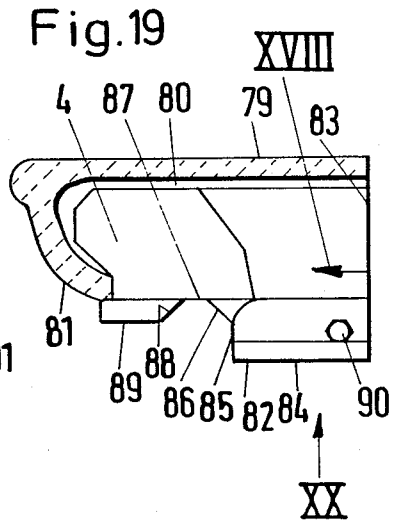
Figure 18:
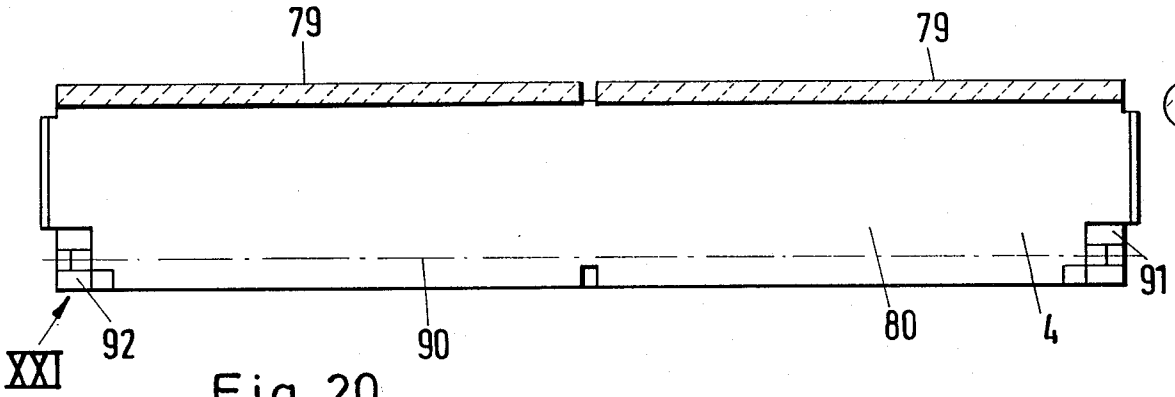
Figure 20:
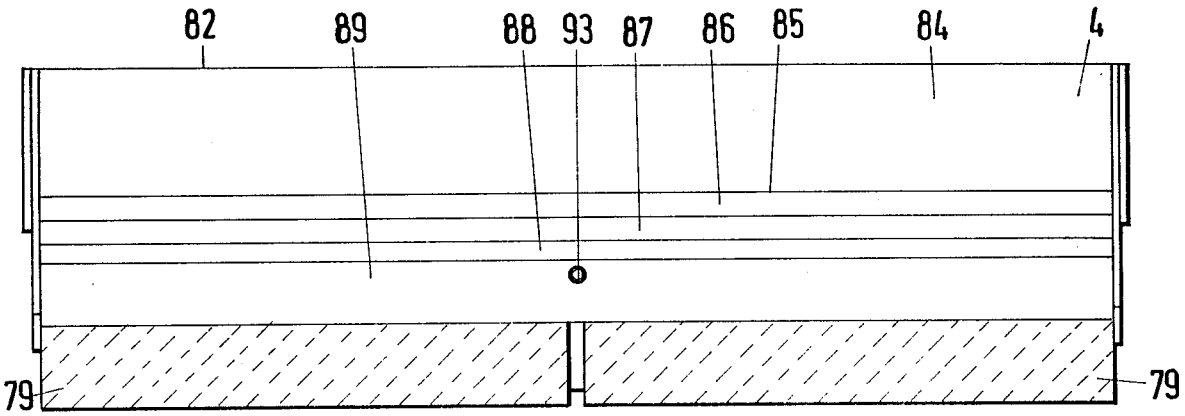
Figure 21:
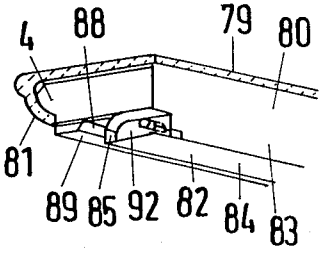

The cornice lintel 4 (FIGS. 18 to 21) has on its upper side two adjacent tiles 79, which are fixed on a supporting section 80, which preferably consists of concrete. The tiles 79 are drawn over the face 81 of the supporting section 80 (FIG. 19). On the underside of the supporting section 80 there is a lintel sheet 82, which extends over the entire width and length of the cornice lintel 4. The lintel sheet 82 ends flush with the rear 83 of the supporting section 80 and has a straight sheet section 84, which extends from this rear and, at about half the width of the cornice lintel 4, goes into a vertically upward-directed sheet section 85. This goes into an intermediate piece 86 running obliquely in the direction of the face 81, which intermediate piece is joined via a connecting piece 87 running parallel to the sheet section 84 and at a smaller distance from the tile 79 to an intermediate piece 88 running oppositely obliquely. The piece 88 adjoins at an obtuse angle an end piece 89, which runs parallel to the sheet section 84 and lies on the same level as the transition from the sheet section 85 to the intermediate piece 86.

The supporting section 80 has, at a small distance above the sheet section 84 of the lintel sheet 82, a tie rod 90 passing through it, which runs parallel to the sheet section 84 and to the rear 83. The two ends of the tie rod 90 lie in end depressions 91 and 92 of the supporting section 80, which are delimited downward by the sheet section 84 and extend into the flat rear 83 of the supporting section 80.

The cornice lintel 4 represented in FIGS. 18 to 21 has only two adjacent tiles 79. However, as represented in FIG. 1, it may also have three tiles lying side by side in a series. The window lintel may also have only a single tile or, for example, two and a half tiles, depending on the dimensions of the tiled stove to be assembled. For fixing the pipe door 10 (FIG. 1), a nut 93 (FIG. 20) is provided halfway along the end piece 89 of the lintel sheet 82. It is fixed on the end piece 89 on the side turned toward the supporting section 80, so that it is embedded in the concrete material of the supporting section and is securely retained.

Figure 23:
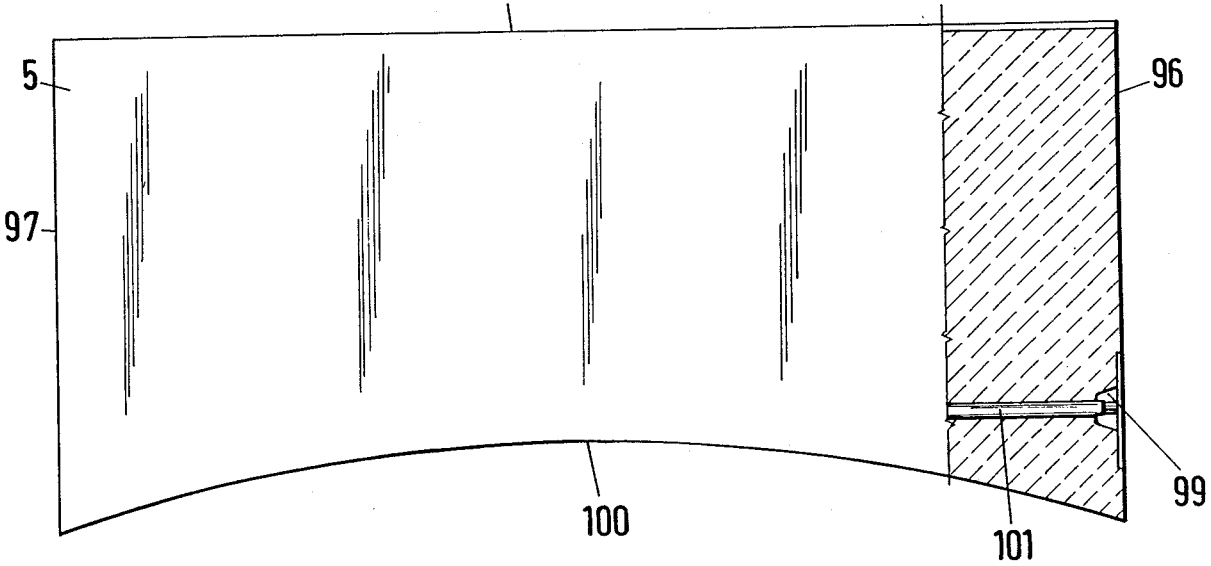
Figure 22:
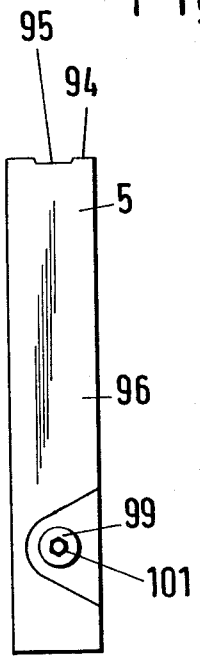

The base arch 5 (FIGS. 22 and 23) has in its flat upper face 94 a centrally lying depression 95, which extends over the entire length of the base arch and into which the interlocking member 54 of the modular elements 2 (FIGS. 4 to 7) engage in the assembled position. This permits simple alignment of the modular elements 2 with the base arch 5. In each of the flat side areas 96 and 97 of the base arch 5 there is a depression 99. The depressions 99 lie in line with each other adjacent to the concavely curved underside 100 of the base arch. In the depressions 99 lie the two ends of a tie rod 101 passing through the base arch 5. The substantially cuboid base arch 5 advantageously likewise consists of concrete.

Figure 25:
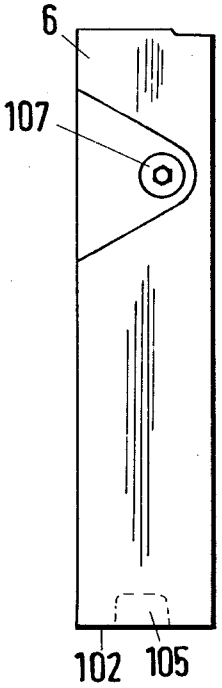
Figure 24:
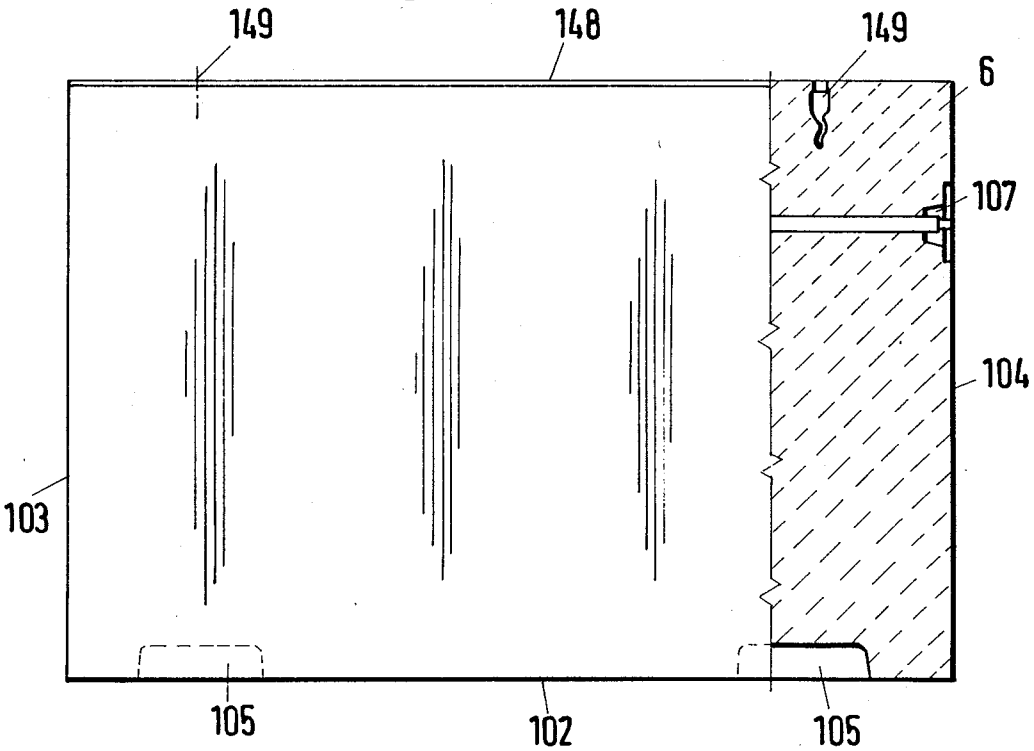

The front door base 6, likewise of cuboid design (FIGS. 24 and 25), has on its flat underside 102 two depressions 105 at half the thickness and closely neighboring the side areas 103 and 104 lying parallel to each other, in which depressions the adjustment elements 40 for vertical leveling can be accommodated. In the upper half of each of the side areas 103, 104 there is a depression 107 provided. In the depressions 107 lie the two ends of a tie rod 108 passing through the front door base 6.

Figure 26:
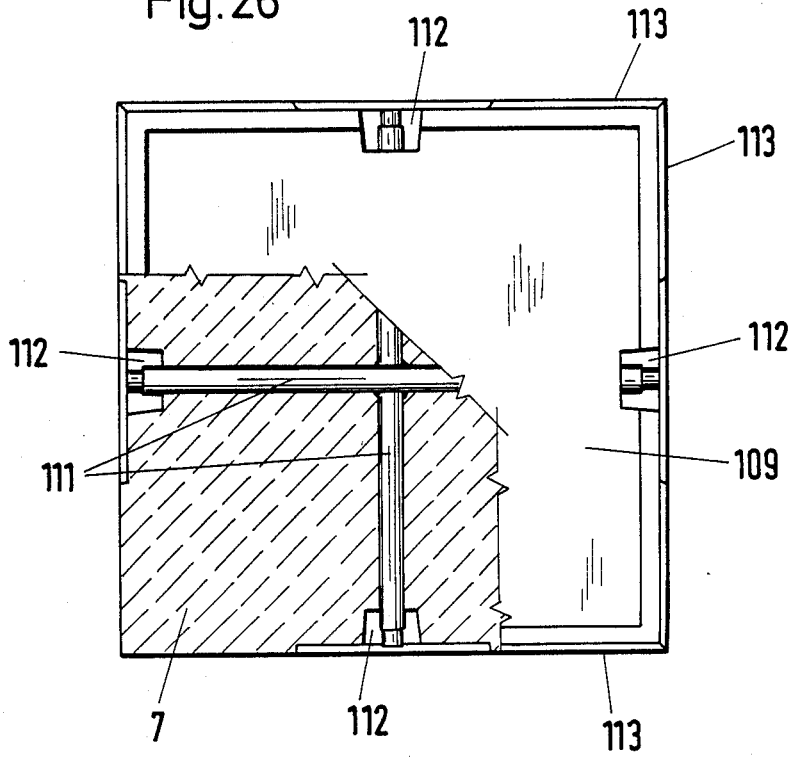
Figure 27:
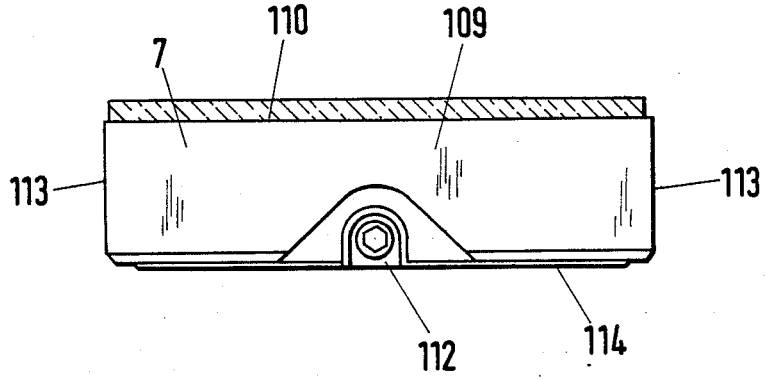

The cover plate 7 (FIGS. 26 and 27) has a supporting section 109, which preferably consists of concrete and on which a tile 110 is fixed. The section 109 has two mutually crossing tie rods 111 passing through it, the ends of which each lie in a depression 112. As FIG. 26 shows, the depressions 112 lie at half the width of the outer side 113 of the supporting section 109. In addition, the depressions 112 are open toward the flat underside 114 of the supporting section 109.

Figure 28:
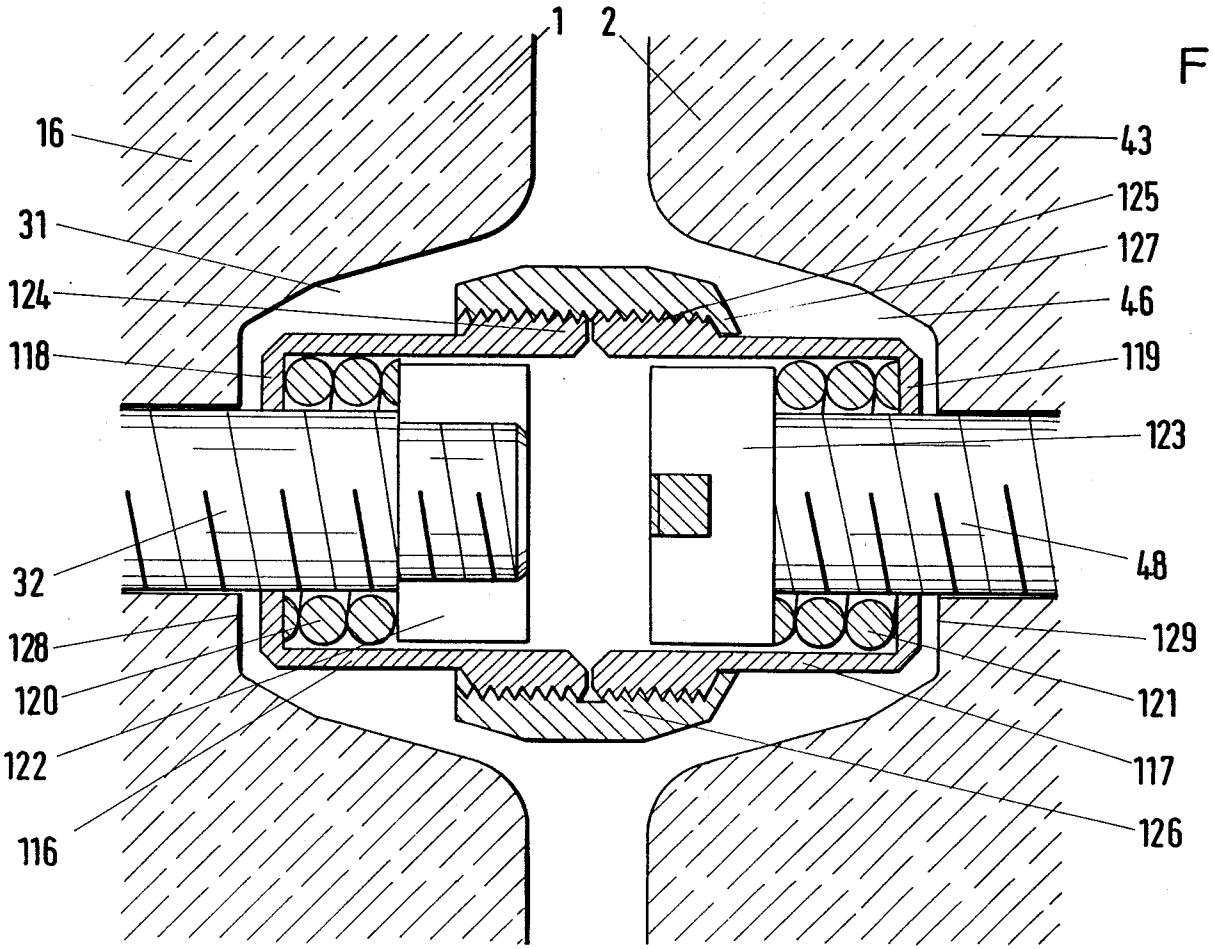

FIG. 28 shows how adjacent modular elements 1 and 2 are connected to each other by means of the respective tie rods 32 and 48. The tie rods 32 and 48 are embedded in the supporting sections 16 and 43 and are preferably designed as polygonal rods, which can be arranged securely fixed against torsion in the supporting sections. Onto each of the rod ends lying in the depressions 31 and 46 is pushed a bush 116 and 117, which have at one end a bottom 118, 119 with a central opening for passage of the respective tie rod 32 and 48. Bearing against the bottom 118, 119 is in each case one end of a compression spring 120, 121, which lies with its other end in contact with a stop part 122 and 123 seated on the free rod end. The stop parts may be nuts screwed on the rod ends. Both bushes 116, 117 have, at the free end, a lip 124, 125 of increased external diameter, which are provided with external threads. Seated on the bush 117 is a nut 126 which forms a coupling and which can be screwed onto both lips 124, 125. For axial securing, the nut 126 has a truncated cone-shaped bottom 127 which has the bush 117 passing through it and, in the end position of the nut 126 represented in FIG. 28, comes into contact with the lip 125 of the bush 117.

Before assembly of the modular elements 1 and 2, the respective bushes 116, 117, which have not yet been connected to each other by the nut 126, lie in contact with the bottom 128, 129 of the depressions 31, 46, under the force of the compression springs 120, 121.

As previously described, in the embodiment according to FIGS. 4 to 7, the modular elements 2 are provided with the interlocking member 54, which engages in the depression 95 (FIG. 22) of the base arch 5. In this way, the modular element 2 is aligned with the neighboring modular element 1 in such a way that the tie rods 32, 48 passing through these modular elements are precisely in line with each other. In the region of the depressions 31, 46, the side areas are designed slightly depressed, so that in this region there remains a gap open to the front 15, 42 and, respectively, the back 17, 50 of the supporting sections 16, 43 when the modular elements lie against each other with their corresponding side areas. The gap is wide enough for an open-end wrench to be inserted to turn the nut 126. The latter is used to connect the two bushes 116, 117 to each other, during which they are pushed toward each other against the force of the compression springs 120, 121 on the tie rods 32, 48. The maximum displacement of the bushes 116, 117 is reached when they are in contact by their faces and the nut 126 is in contact by its truncated cone-shaped bottom 127 with the lip 125 of the bush 117. The compression springs 120, 121 ensure a secure connection of the modular elements to each other. In the same way, all adjacent modular elements are connected to each other. As the base arch 5, the base parts 9 and 12 of the modular elements 1 and 3 and the front door base 6 are also provided with such tie rods, these modular elements are also connected to each other and braced in the same way. In this way, a bracing which is continuous through the corresponding walls of the tiled stove is achieved, producing a particularly firm union of the various modular elements of the tiled stove.

Figure 29:
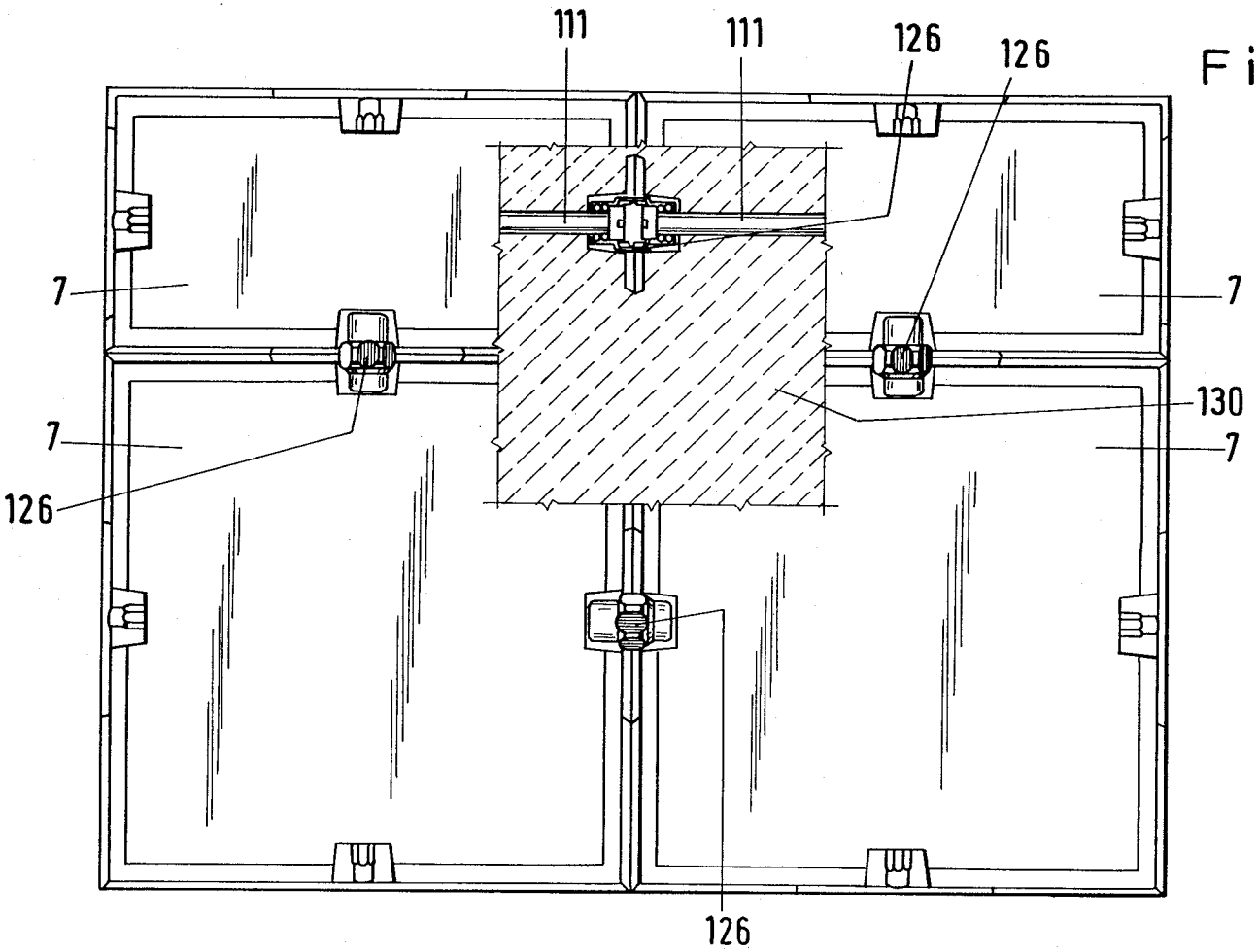

FIG. 29 shows the bracing of various cover plates 7. The plates may have the same, or as shown in FIG. 29, different dimensions. The ends of the tie rods 111, which are provided crossing each other in each cover plate 7, are in each case connected to a nut 126 in the manner described with reference to FIG. 28. In this way, the cover plates can easily be aligned with one another. Owing to the mutually crossing tie rods 111, a stable union of cover plates 7 is produced, so that the cover 14 formed from them (FIG. 1) has a very high stability.

Figure 30:
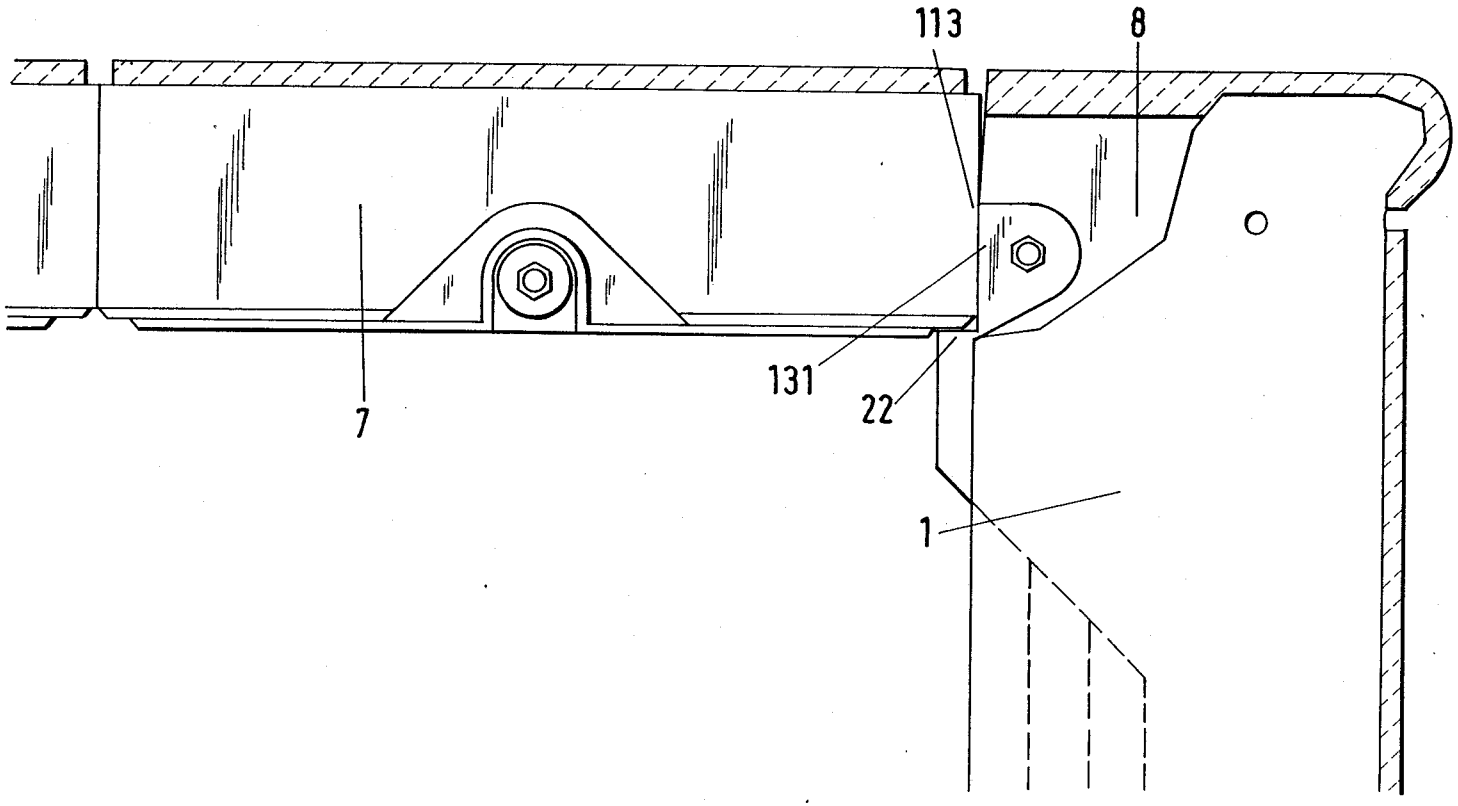

FIG. 30 shows that the cover plate 7 rests with its edge region on the shoulder 22 of the modular element 1. In this arrangement, the cover plate 7 lies with its outer side 113 against the rear surface 131 of the upper cornice 8 of the modular element 1.

In the exemplary embodiment, the modular elements 3, which form the corner elements are also provided with such a shoulder 22, so that the cover 14 formed from the cover plates 7 securely rests on the respective shoulders 22 of the corresponding modular elements 1 and 3 in the corner regions of the tiled stove. As the modular elements on the one hand and the cover plates 7 on the other hand are firmly braced to one another, the cover 14 can be safely borne on the shoulders 22. As the cover 14 rests loosely, it can easily be taken off at any time if required.

The pipe door 10 (FIG. 1) is surrounded by the modular elements 2, the upper ends of the modular elements 1 and 3 and by the cornice lintel 4.

The front door 13 (FIG. 1) is surrounded by the modular elements 1 and 3, the front door base 6 and the cornice lintel 4.

Figure 31:
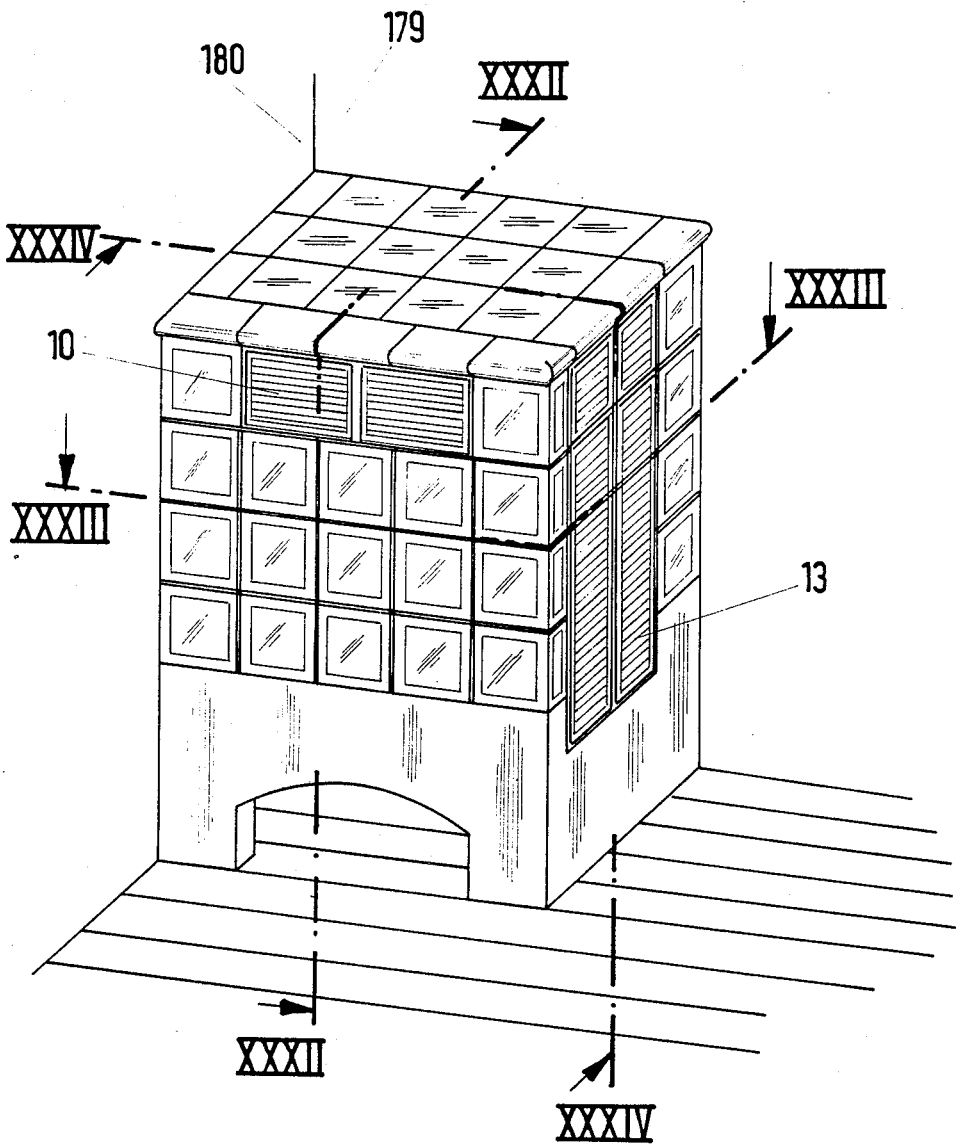
Figure 32:
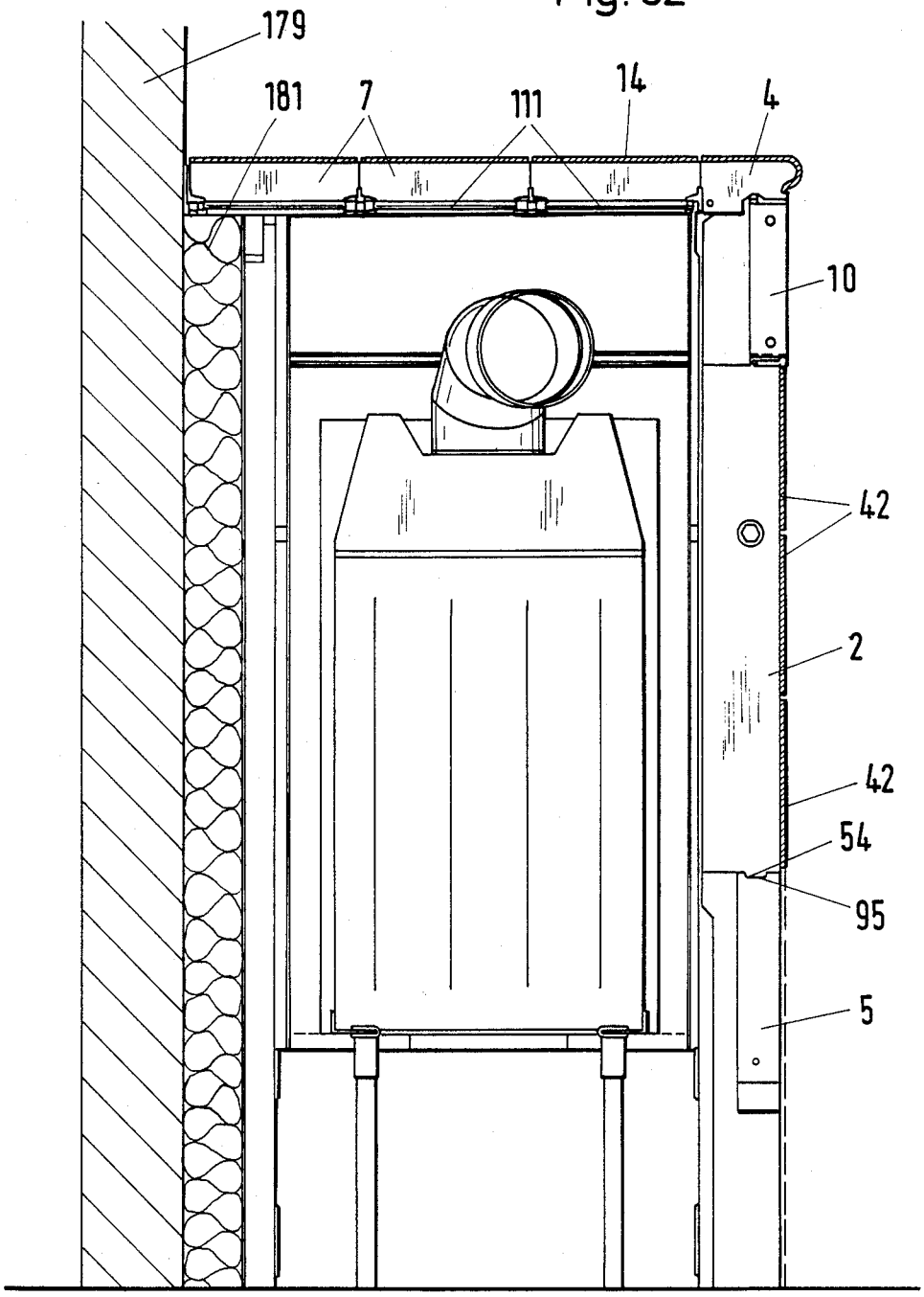

The tiled stove according to FIG. 31 is assembled in such a way that it adjoins a wall 179. The cover 14 formed from the cover plates 7 runs up to the wall 179. The cover 14 closes off at the top insulation 181 (FIG. 32) which lies in contact with the wall 179 and extends over the height of the tiled stove. FIG. 32 clearly shows the tie rods 111 passing through the cover plates 7 and connected to one another in the way described. In this way, the continuous bracing of the cover 14 is achieved. The cover 14 is surrounded by the cornice lintel 4. In a side wall of the tiled stove, underneath the cornice lintel 4, is the pipe door 10, which is arranged on the modular elements 2. In the exemplary embodiment, there are three tiles 42 arranged one on top of the other in a series. Depending on the size of the tiled stove, the modular elements 2 may also have less or more tiles. The width of the modular elements 2 may also correspond to the width of a tile, or to the width of half a tile. Similarly, of course the modular element 2 may also have a width which corresponds to one and a half times the tile width, twice the width, two and a half times the width etc. The modular elements 2 are mounted on the base arch 5, in whose face depression 95 the modular elements engage with their projection 54.

Figure 33:
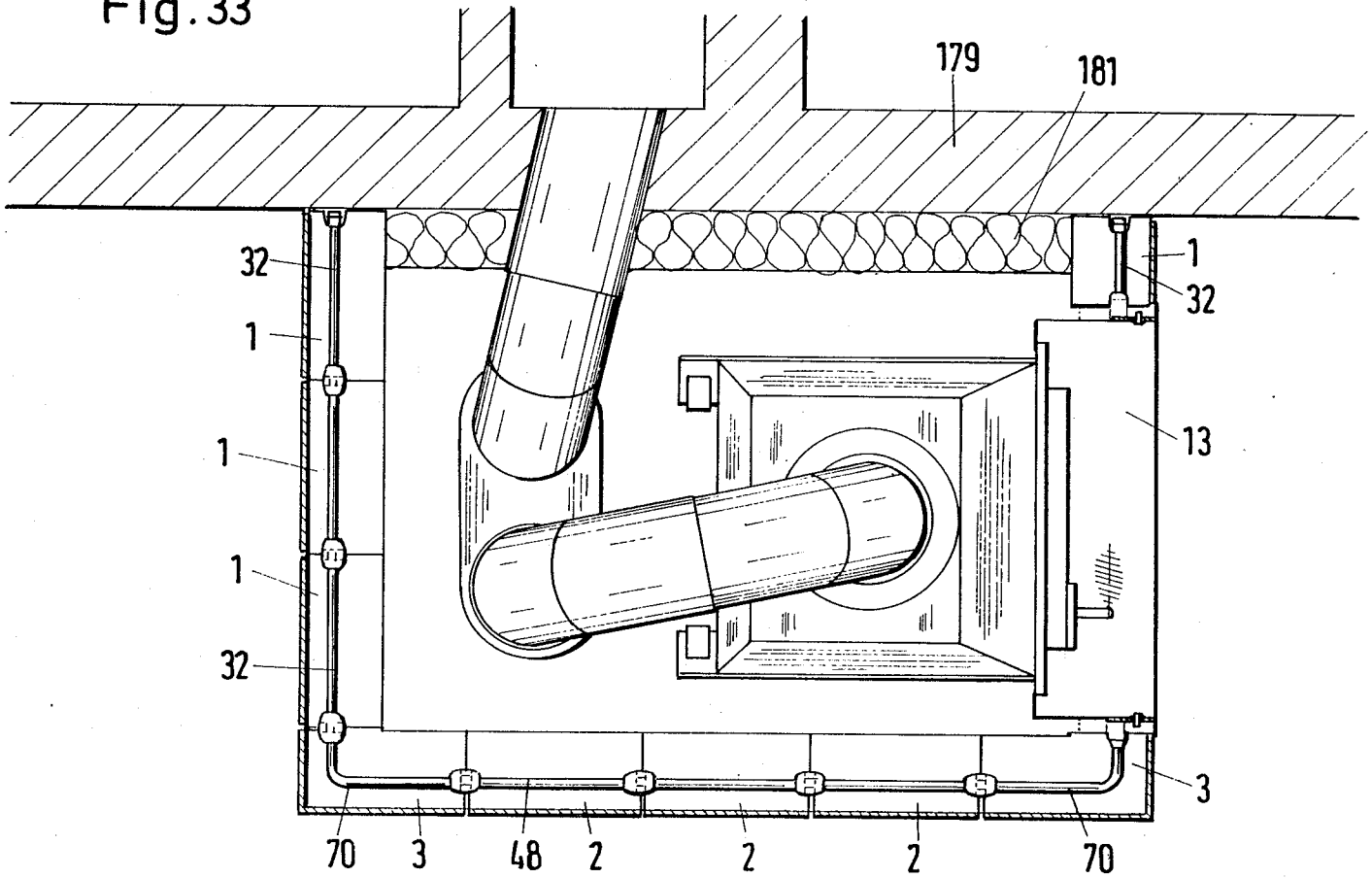
Figure 34:
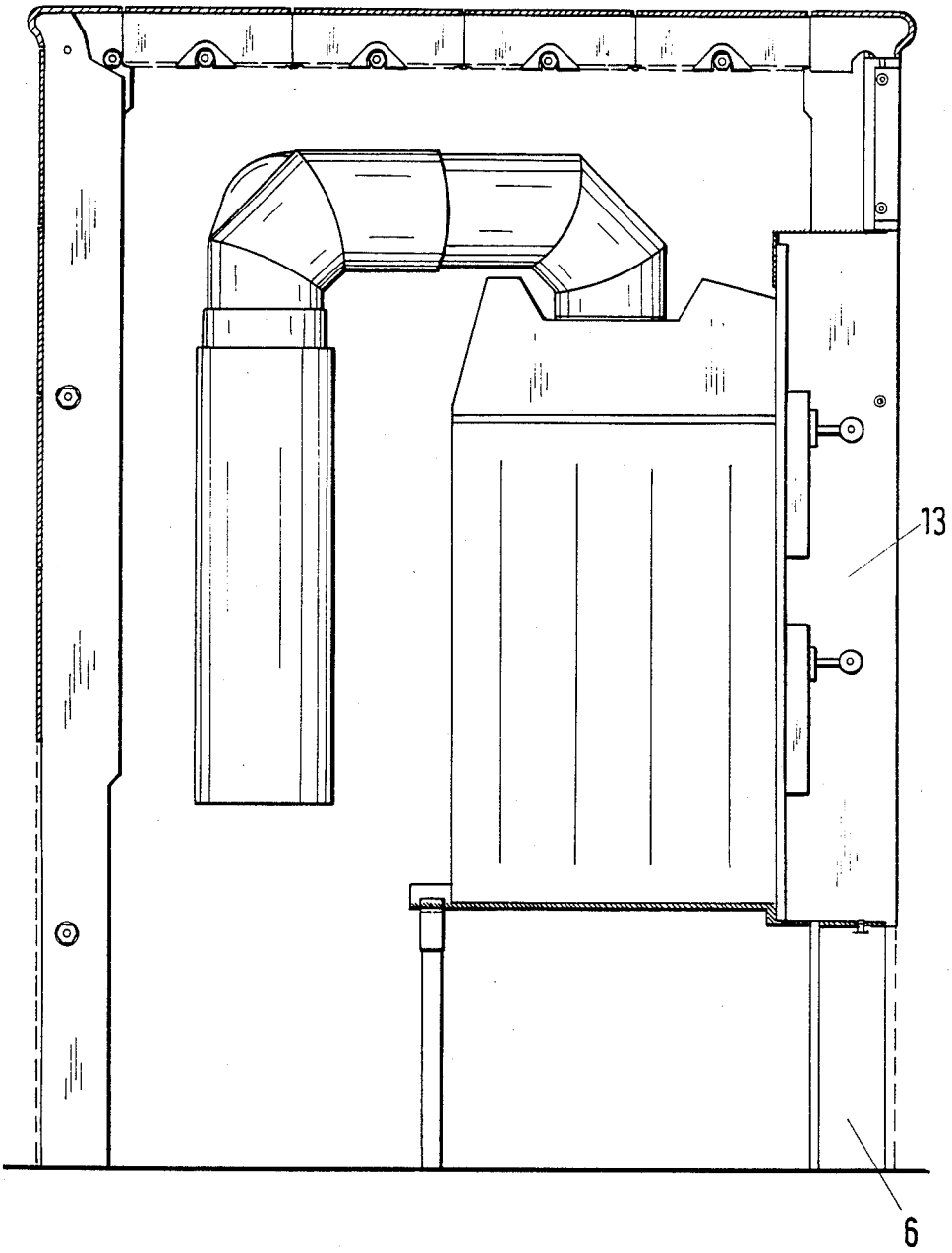

As FIG. 33 shows, the adjacent modular elements 1 to 3 are provided with the continuous bracing which is formed by the tie rods connected to each other. The bracing is continuous even in the region of the corner modular elements 3, as the tie rods 70 are correspondingly bent off at right angles.

Figure 45:
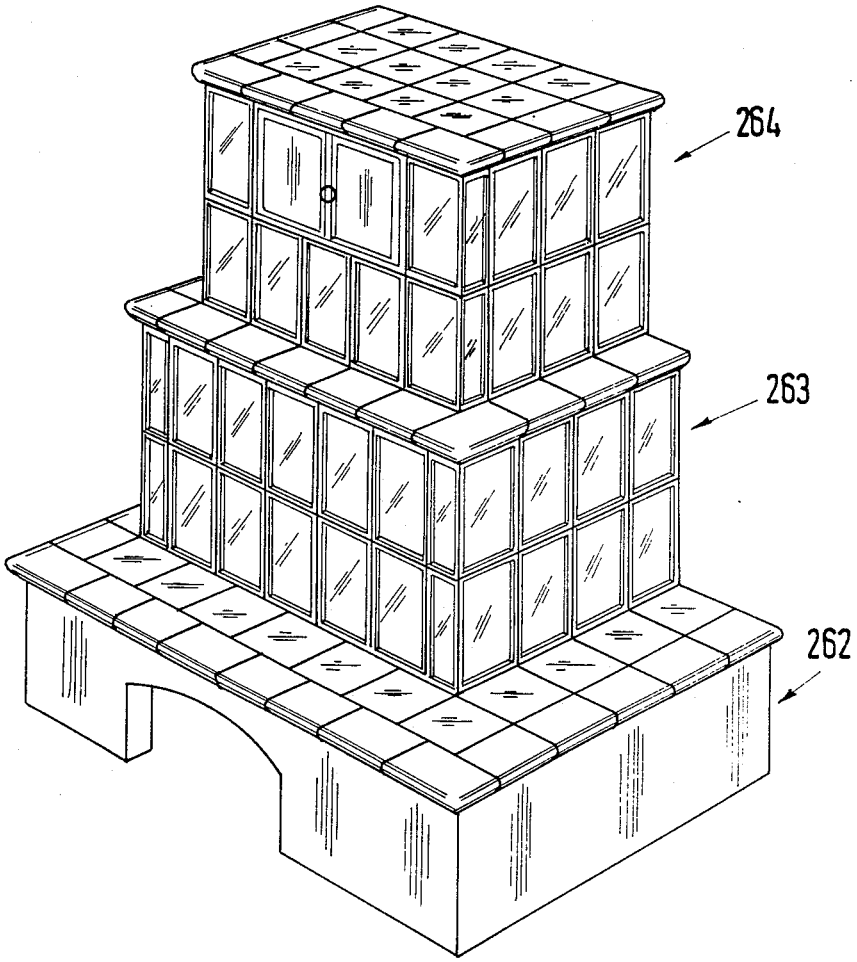

As the modular elements 1 and 3 are provided with the shoulder 22 close to their top end at their rear (FIGS. 3 and 30), the tiled stove may also be provided with a tiered design, as drawn in FIG. 45. In this case, the shoulders 22 in each case have the above-lying modular elements mounted on them. The outer walls of the tiled stove are thus given a steplike design. It is also possible to support a horizontal plate, a grid or the like on the shoulders 22, so that the tiled stove can for example be provided with a seat at sitting height. In this way, a great variety of possibilities in the designing of the tiled stove is achieved.

The element structure described may also be used in prefabricated construction, for instance for the erection of interior wall elements, e.g., in house construction. Similarly, the described element construction can be used, for example, for producing a floor of individual modular elements, preferably in heated floors. When used in prefabricated construction, the modular elements can have recesses for receiving different types of adjusting pieces, fittings, etc.

Hereafter, modular units are described which are combined to form modular elements, from which the element structure is then assembled in the way described.

Figure 35:
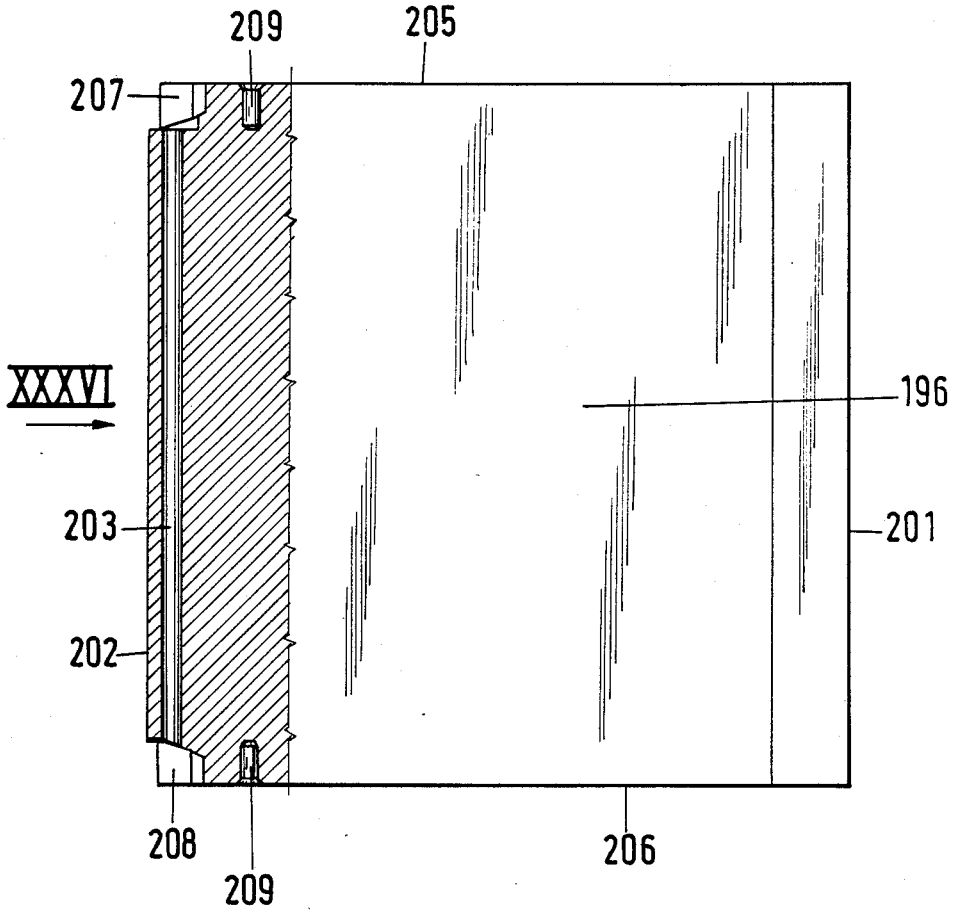
Figure 36:
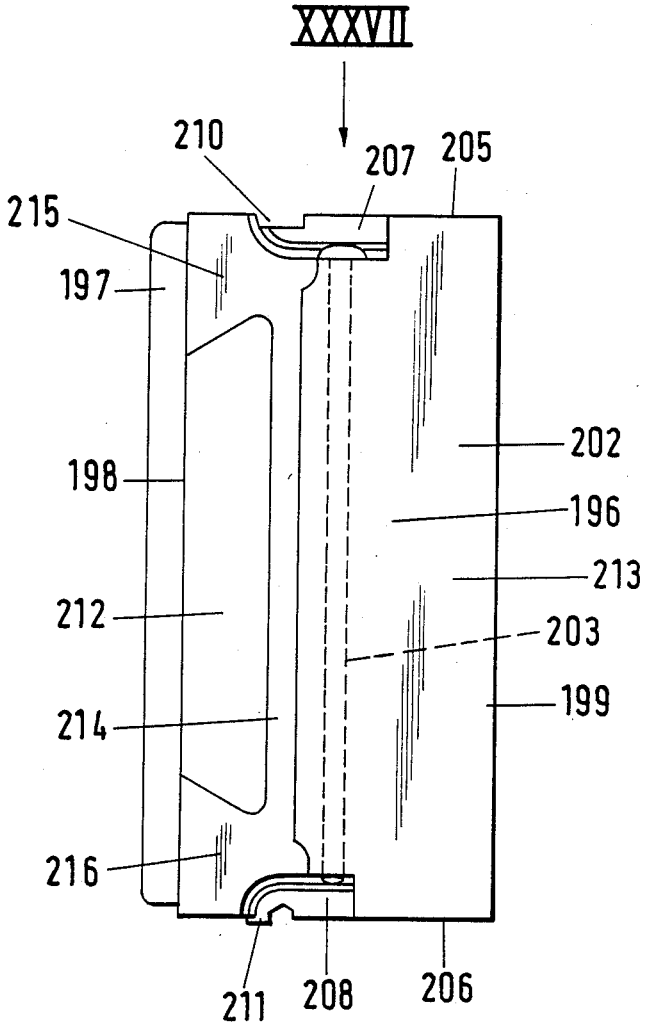
Figure 37:
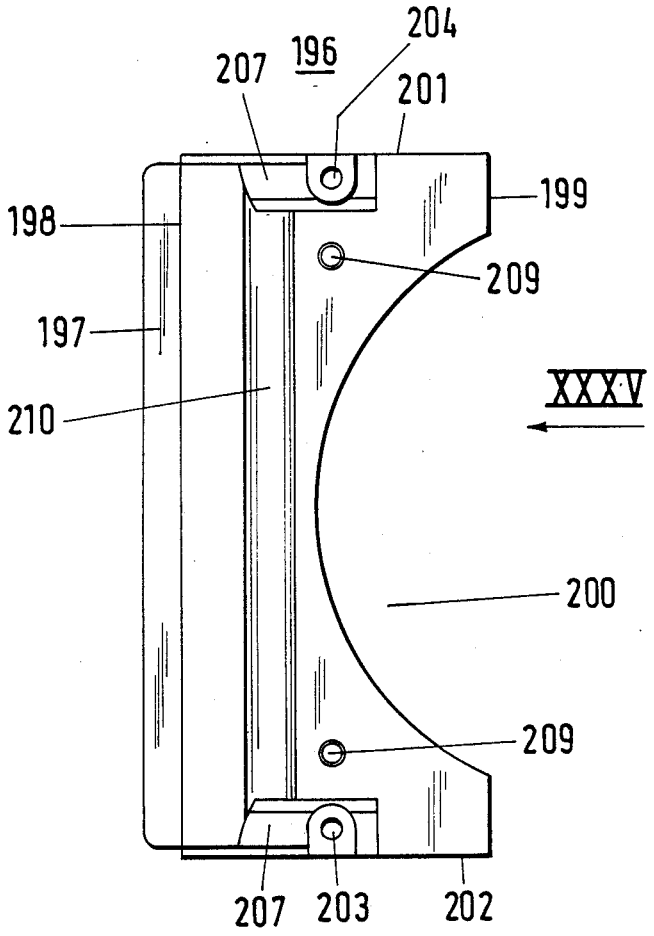

The modular unit 196 according to FIGS. 35 to 37 may be used for forming the side walls or the cover plate of the tiled stove. In this embodiment, the modular unit 196 has approximately the size of a tile 197, which is provided on the outer side 198 of the modular unit. The inner side 199 is provided with a partial-circular depression 200 (FIG. 37), which extends over the entire height of the modular unit 196. Close to the two side walls 201, 202, the modular unit 196 has two recesses 203, 204 passing through it, which open into depressions 207 and 208 on both sides 205 and 206 of the modular unit. In FIG. 35, only the one recess 203 is shown, with the depressions 107 and 208. The recesses 203, 204 lie at approximately half the width of the side walls 201, 201. In the faces 205, 206 there are centering openings 209, so that modular units lying one on top of the other which have such centering openings can easily be set precisely one against the other by means of centering pins. In place of the recesses 203, 204, groove-like depressions or the like extending across the length of the side walls 201, 202 of the modular element can also be provided.

The depressions 207, 208 are open toward the side walls 201, 202 and towards the faces 205, 206.

The modular unit 196 has, on its upper, flat face 205, close to the outer or front side 198, a groove 210 which is continuous over the width. In the lower, flat face 206 there is a fillet 211 provided, projecting beyond it (FIG. 37), which extends on a level with the groove 210 likewise over the width of the modular unit 196. If the modular units 196 are placed one on top of the other, the fillet 211 engages the groove 210 of the respective modular unit underneath.

The side walls 201, 202 are provided with flat stop areas 212, 213, by which horizontally neighboring modular units 196 lie against each other. The two stop areas 212, 213 are separated from each other by a groove 214, which may serve for accommodating pipe door frames. As is apparent in the exemplary embodiment according to FIG. 1, such pipe doors 10 may be provided on one side wall of the tiled stove, whose frames engage in the grooves 214 of the modular units 196. The stop area 213 extends over more than half the thickness of the modular unit 196 (FIG. 36) and up to the rear or inner side 199. The stop area 212 has an approximately trapezoidal outline and is substantially narrower than the stop area 213. The stop area 212 extends up to the outer side 198.

Figure 41:
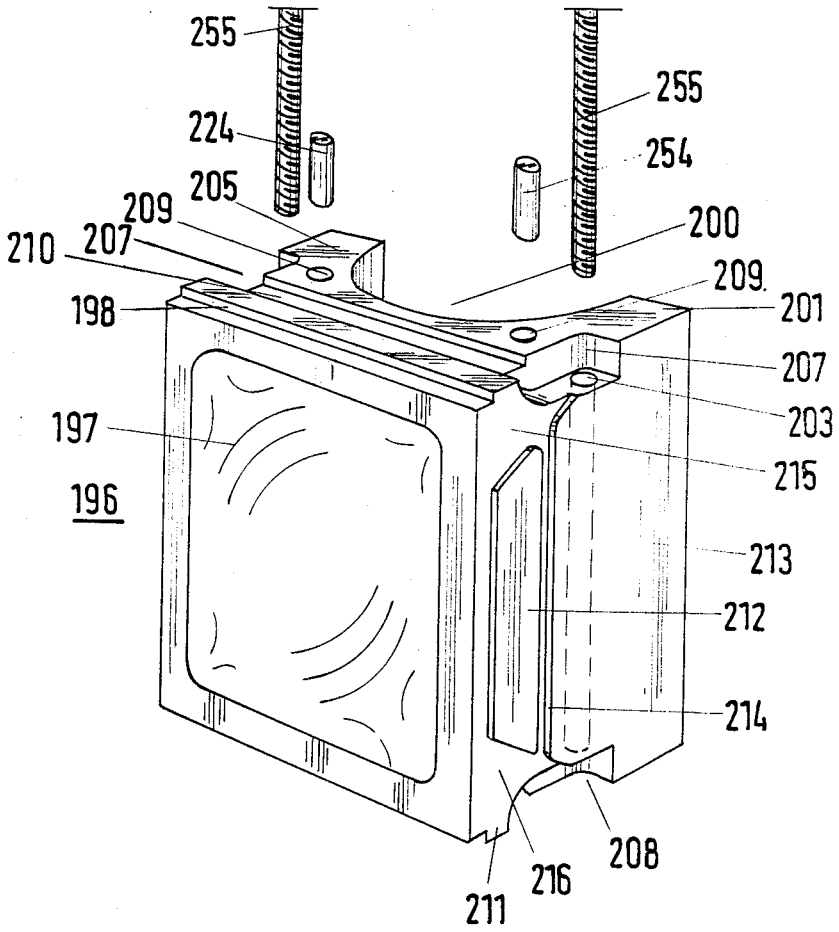

In FIG. 41, the modular unit 196 is represented perspectively. Clearly recognizable are the groove 210 in the flat upper face 201, the rear depression 200, the centering openings 209, the stop areas 212, 213 and the groove 214 running between them. Furthermore, in FIG. 41 the depressions 207 and 208 into which the recesses 203 open are clearly recognizable. The groove 214 for its part opens out at both its ends, in each case into a depression 215, 216 (FIGS. 36 and 41) which is provided in the side walls 201, 202 and extends upward and downward to the faces 205, 206 and forward to the outer side 198 of the modular unit 196. These depressions 215, 216 in the two side walls 201, 202 also extend into the region of the recesses 203, 204.

The modular unit 196 may also have, instead of the tiles, a natural stone facing, concrete or another material. Likewise, it is possible to design the entire modular unit itself as a tile. The rear depression 200 has the advantage that the modular unit 196 has low weight. Nevertheless, the modular unit 196 is sufficiently thick in the region of the side walls 201, 202 for the recesses 203, 204 provided there to weaken the modular unit only insignificantly. Instead of the two recesses 203, 204, the modular unit 196 may also have one recess at half its width. The rear depression 200 does not have to be rounded; it may also have any other suitable outline.

Figure 38:
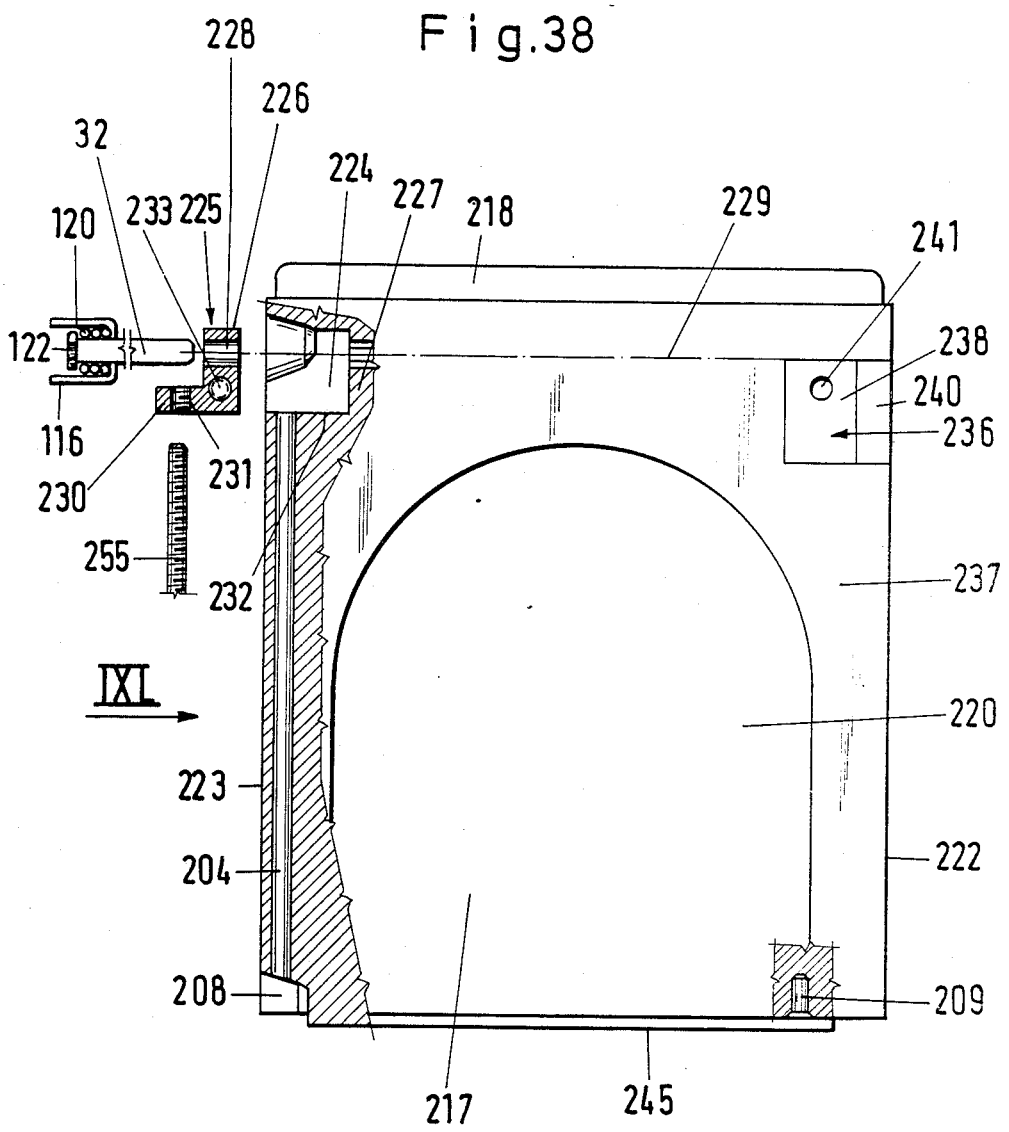
Figure 39:
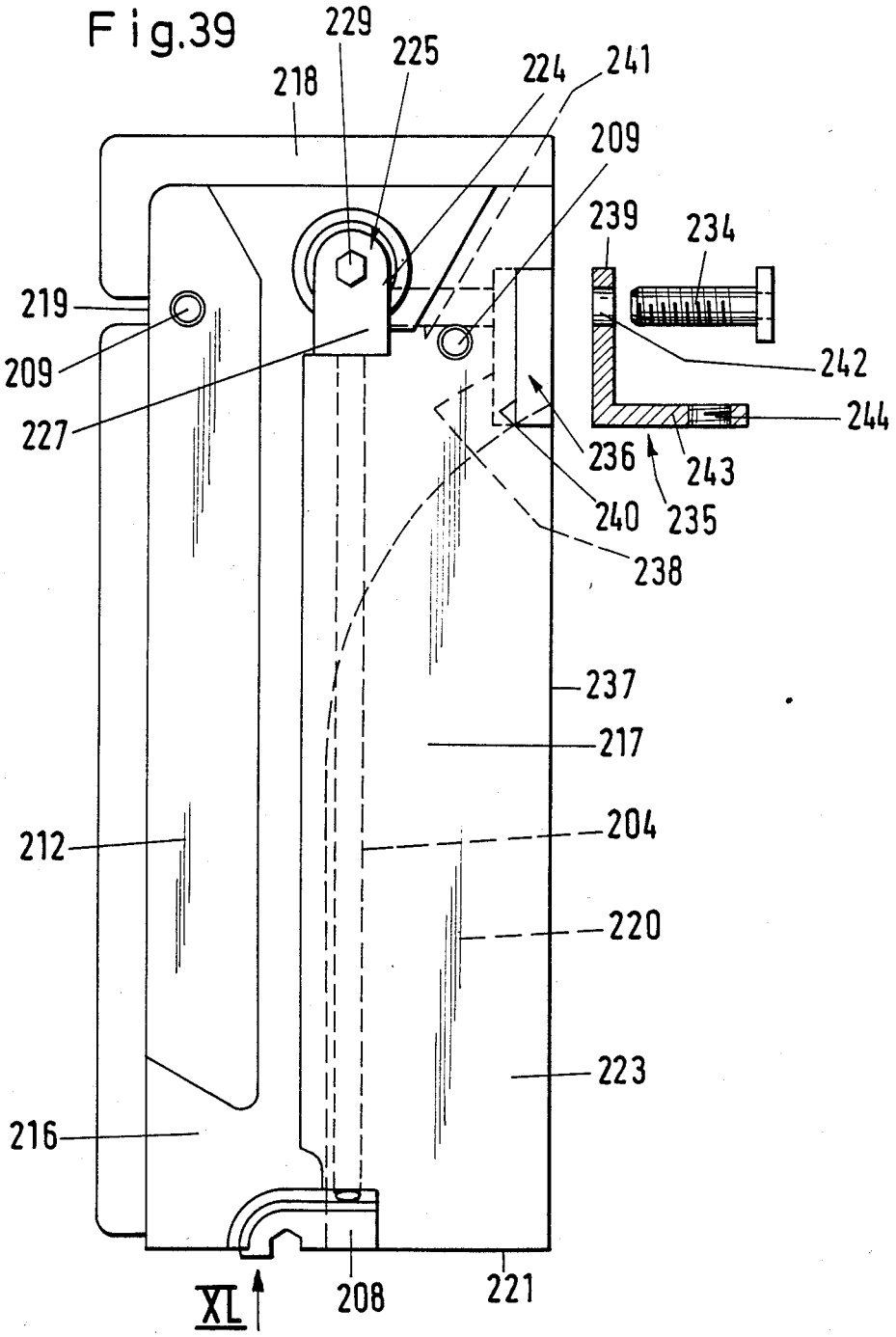
Figure 40:
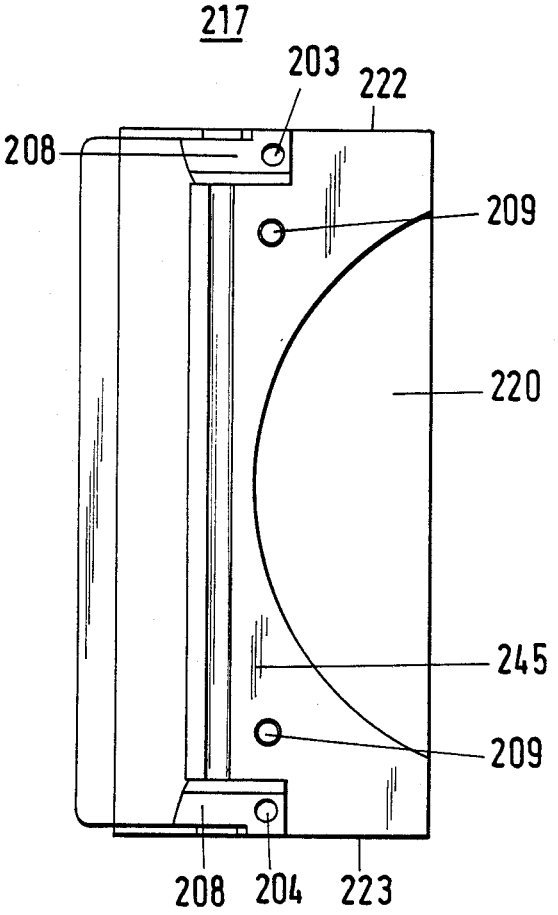

FIGS. 38 to 40 show a further modular unit 217, which is of similar design to the modular unit 196 according to FIGS. 35 to 37 and 41. The modular unit 217 additionally has a cast-on cornice 218, which is drawn down over the outer side 219 of the modular unit (FIG. 39).

As the modular unit 217 forms the upper termination of a tiled stove, the depression 220 in the rear is closed to the top against the cornice 218 (FIGS. 38 to 40). In the lower, flat face 221, on each of the two side walls 222, 223 a depression 208 is provided, into which in turn a recess 203, 204 opens in each case. Both recesses pass vertically through the modular unit 217. At the upper end, the recesses 203, 204 each open into a recess 224 (FIGS. 38 and 39), which is open in the direction toward the side walls 222, 223. A retainer 225 has an L-shaped cross-section is inserted into each of the recesses 224. The leg 226, which is vertical in the installation position, of the retainer 225 lies in contact with a rear wall 227 of the recess 224 and has a bore 228 for the tie rods 32 and 48, respectively (FIG. 28). As FIG. 39 shows, the bore 228 has an angular cross-section and is in line with a recess 229 passing through the modular unit 217 close to the cornice 218 (FIG. 38), through which recess the tie rod can be inserted. The recess 229 opens into the recess 224 (not shown in the drawings) in the opposite side wall 222. The legs 230, which is horizontal in the installation position, of the retainer 225 has a threaded bore 231 and rests on a bearing surface 232 of the recess 224. The threaded bore 231 is in line with the recesses 203 and 204. The rear wall 227 of the recess 224, and consequently also the leg 226 of the retainer 225, have a substantially rectangular form, their upper end being rounded off semicircularly (FIG. 39).

In the corner region, the retainer 225 is provided with a further threaded bore 233 which, according to FIG. 38, lies perpendicular to the bores 228, 230, which are at right angles to each other. Into the threaded bore 233 can be screwed a threaded bolt 234 (FIG. 39), with which an angle piece 235 can be fixed on the modular unit 217. The angle piece 235 is fitted in a recess 236 which is provided in the rear 237 of the modular unit and is also open toward the corresponding side walls 222, 223. In FIG. 38, only the one recess 236 in the region of the side wall 222 is represented. The recess 236 has a flat bearing surface 238 for the vertical leg 239 of the angle piece 235. The bearing surface 238 lies depressed in the recess 236, which has a further flat surface 240, which is set back from the rear 237 (FIG. 39). The bearing surface 238 and the surface 240 of the recesses 236 lie parallel to the rear 237. In the bearing surface 238 and in the leg 239 of the angle piece 235 there is in each case a recess 241 and 242 provided for the passage of the threaded bolt 234. The recess 241 in the modular unit 217 extends up to the threaded bore 233 of the retainer 225 lying adjacent to the angle piece 235 (FIG. 39). The angle piece 235 is fitted into the recess 236 in such a way that it lies in contact by its leg 239 with the bearing surface 238. The angle piece 235 is then retained in the recess 236 by the threaded bolt 234, which is screwed into the threaded bore 233 of the retainer 225. In the installation position, the horizontal leg 243 of the angle piece 235 protrudes beyond the rear 237 of the modular unit 217 and is provided on the projecting part with a threaded bore 244.

In the case of a tiled stove, a cover plate may be supported on the protruding part of the leg 243. This means that the modular unit 217 does not require a shoulder, as is necessary for example with the modular element 1 according to FIGS. 2 and 3. It is also possible to place a modular element on the projecting limb part, so that the tiled stove wall may have a step-like design, as represented for example in FIG. 45.

The modular unit 217 is likewise provided with the centering openings 209 in the lower face 245. The stop area 212 in the side walls 222, 223 of the modular unit 217 extends up to the cornice 218 (FIG. 39), while, at the lower end, the stop area 212 delimits the depression 216 which adjoins the depression 208.

Figure 48:
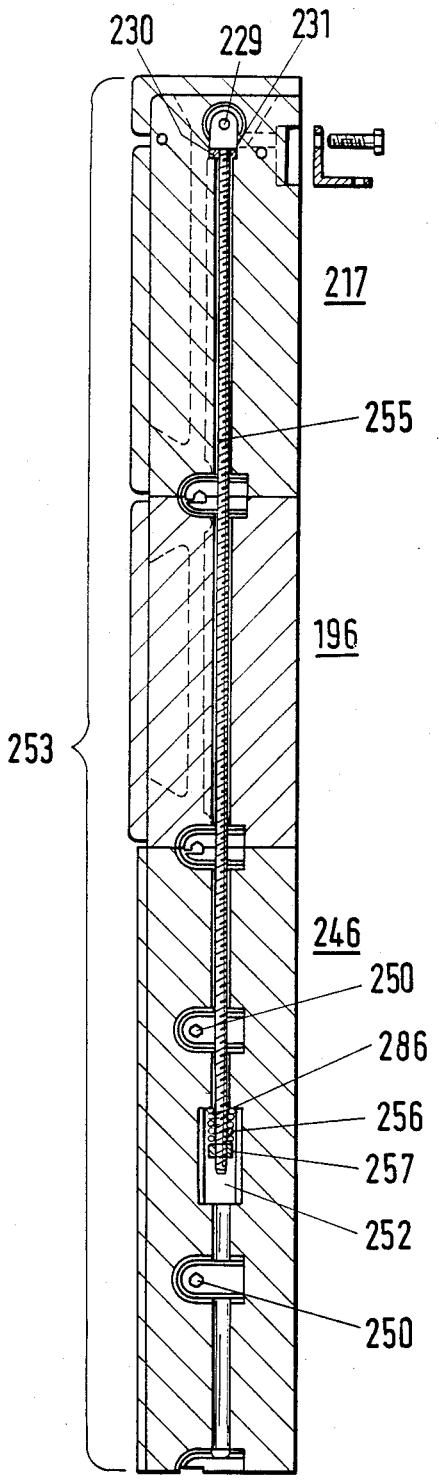
Figure 49:
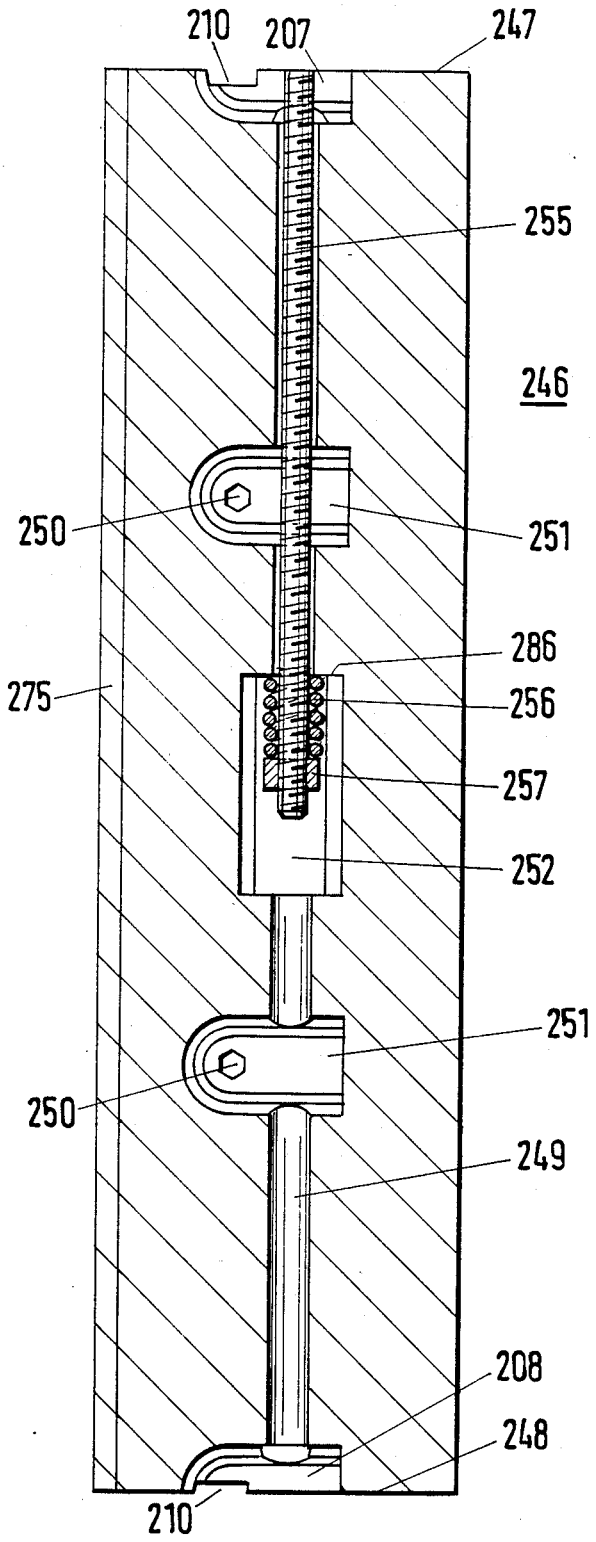

FIG. 49 shows a further modular unit 246, designed as a base. It is provided on both the flat faces 247 and 248 with the depressions 207 and 208, into which a recess 249, passing in vertical direction through the modular unit, opens. The depressions 207, 208 are of the same design as in the case of the embodiment according to FIGS. 35 to 37 and 41. These depressions 207, 208 and the recesses 249 are again provided in the region of the two side walls of the modular unit 246. However, just as before in the case of the preceding embodiments, the recess 249 may also be provided in half the width of the modular unit. In FIG. 49, the modular unit 246 has two recesses 250, which run perpendicular to the recesses 249, passing through it, which can accommodate the tie rods 32 and 48 (FIG. 28), with which adjacent modular elements consisting of modular units can be braced against each other. These recesses 250 have, corresponding to the previous embodiments, angular cross-section and open into recesses 251 in the side walls of the modular unit 246. Between the recesses 251, a rectangular recess 252 is provided in the side walls, which opens into the recess 249 and serves as an assembly opening, as is to be explained in more detail with reference to FIG. 48. In the faces 247, 248 are additionally provided grooves 210, into which the fillets 211 (FIG. 36) of neighboring modular units can engage, in the assembled position.

FIG. 48 shows one possibility of clamping together the modular units 196, 217 and 246, lying one on top of the other, to form a modular unit 253. The modular elements can easily be set precisely one on top of the other by means of the centering openings 209 and the centering pins 254 inserted in them (FIG. 41) as well as the grooves 210 and fillets 211. The recesses 203, 204, 249 of the modular units then lie in line with one another and form a continuous opening for receiving a tie rod 255. It is preferably designed as a threaded rod, but may also be provided with thread only at the two ends. The tie rods 255 are then screwed by their upper end into the threaded bore 231 of the retainer 225 (FIG. 38). The tie rods 255 are of such a length that they protrude at their lower end into the recess 252 of the modular unit 246 (FIGS. 48 and 49). Onto this tie rod end is pushed a compression spring 256 which is retained by a nut 257 screwed onto the lower tie rod end. Using a corresponding wrench, the nut 257 can be screwed onto the tie rod 255 to such an extent that the modular units 217, 196, 246 mounted one on top of the other are braced sufficiently firmly to one another. In this arrangement, the compression spring 256 bears against a stop 286, which is formed by the upper limiting wall of the recess 252. Through the pressure spring 256, the difference of the thermal expansion between modular members (196, 217, 246) and the tensioning device is taken up in the vertical direction. For every operating condition of the element construction, a substantially constant prestressing of the modular members is thereby assured. As the recesses 252 are open toward the side walls of the modular unit 246, the nuts 257 can be easily actuated. Various modular elements can be assembled from the modular units in the way described, meaning that variously designed modular elements 253 can be created, depending on requirements. The tie rods can also be subdivided into smaller pull rod pieces, which are connected by means of coupling pieces.

These modular elements 253 can then be arranged one against the other and braced against each other by means of the tie rods 32, 48 in the way described with reference to FIG. 28. These horizontal tie rods 32, 48 are inserted through the horizontal recesses 229, 250 of the modular units 217, 246, which run perpendicular to the tie rods 255. These horizontal tie rods 32, 48 may already be provided as a fixture in the modular unit or may be inserted in the recesses during assembly. In each case, before the modular elements are positioned adjacent each other or in their final installed position, they are equipped with the tensioning devices and do not extend in the axial direction beyond the modular element. The difference in thermal expansion between modular element and tensioning device is taken up in the horizontal direction by the compression spring. For every operating condition of the element construction, a substantially constant prestressing of the modular element is thereby assured. Since several such tensioning devices are arranged across the height of the modular elements, the modular elements are simultaneously aligned in exact position with respect to each other and at the same time prestressed across the height of the element. On the tie rod 32 is seated the bush 116 (FIG. 28) which bears against the stop part 122 with the compression spring 120 in between, in the manner already described.

As explained in detail with reference to FIG. 28, the bush 116 is then connected by means of the nut 126 to the bush 117 seated on the tie rod 48 and in this way the adjacent modular elements 253 are horizontally braced to each other. The nuts 126 are also easily accessible when the modular elements 253 are assembled because the modular units 196, 217, 246 have in the side walls 201, 202, 222, 223 the depressions 215, 216, 251, which reach up to the front of the modular units. The modular elements 253 lying one against the other thus have in the region of their adjacent side walls depressions through which a wrench can comfortably be inserted for turning the nut 126. In this way the stressing tendons (stressing members) are stressed through the joints or seams between adjacent modular elements. This has already been described in detail with reference to FIG. 28. With the design described, it is possible also to push the last modular element 253 into the gap between the already assembled wall and the building wall and to brace it horizontally with the already assembled wall.

The modular units 196, 217, 246 described can be set one on top of the other in any arrangement and vertically braced by means of the tie rods 255. Since the depressions 252, into which the recesses for the tie rods open out, are open toward the side walls of the modular elements, the nuts 257 can be manipulated easily by means of a suitable wrench.

Figure 42:
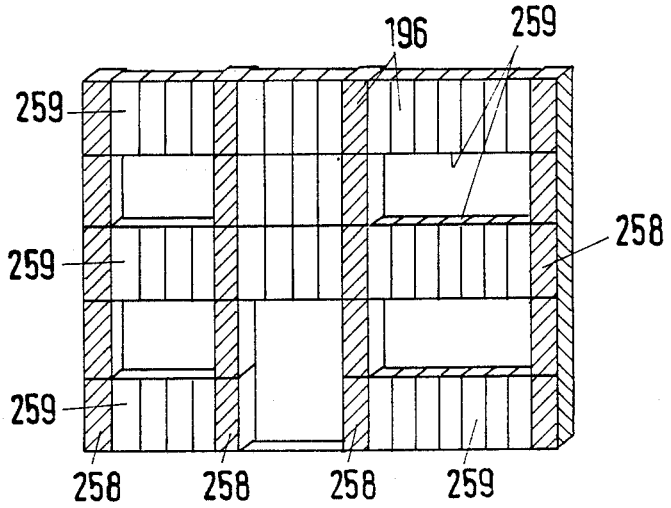

FIG. 42 shows one possibility of producing a wall structure from the modular units according to FIGS. 35 to 41 and 49. This wall structure is a construction facade which can be assembled from the same modular units 196. This construction facade has props 258, which are formed from modular units 196 set one on top of the other, which are braced n vertical direction in the way described by means of the tie rods 255 (not shown). The construction facade additionally has spandrels 259, which are formed by modular units 196 lying horizontally next to one another. They are horizontally braced with one another and with the props 258 by means of the tie rods 32, 48. This horizontal bracing is explained in more detail with reference to FIG. 28. Finally, the two middle props 258 are formed by modular units 196 lying alongside each other and one on top of the other, it likewise being possible for the adjacent modular units to be horizontally braced with each other. In any case, the modular units lying one on top of the other are braced in vertical direction by means of the tie rods 255.

Figure 43:
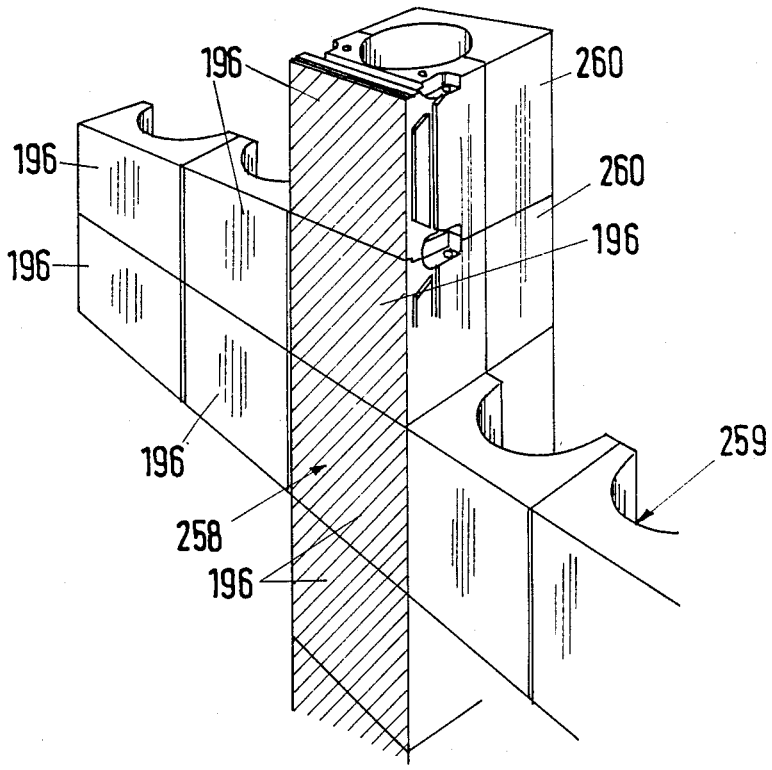

FIG. 43 shows, in enlarged representation, one of the props 258 which is formed from the modular units 196 which are set one on top of the other and vertically braced with each other. Also represented are part of the spandrel 259 and part of the wall located between neighboring props, which is likewise formed from the modular units 196. At the rear of the modular units 196. At the rear of the modular units 196 of the props 258 and/or of the spandrels 259 and/or of the wall located between neighboring props, parts 260 can be fixed, extending these modular units into cuboids. In FIG. 43 a covering is connected to a modular unit or modular element and the construction which lies therebehind. The advantage of this construction is that the covering can be erected simultaneously with the construction, so that subsequent scaffold work can be avoided.

Figure 44:
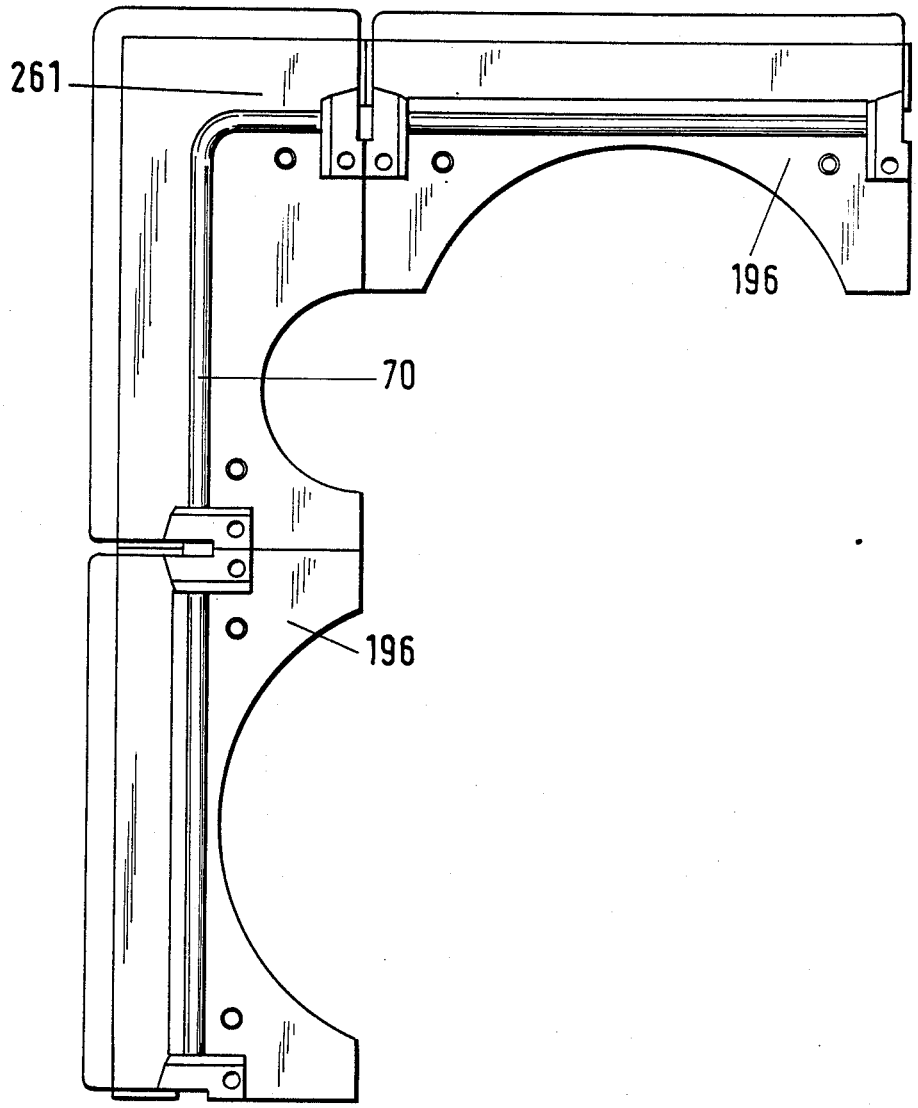

FIG. 44 shows the horizontal bracing of three adjoining modular units 196 and 261. The modular unit 261 forms a corner element, which the two modular units 196 lying at right angles to each other adjoin. The horizontal bracing of these modular units 196, 261 is performed in the same way as has been described with reference to FIG. 33. Instead of the tie rod 70 bent off at right angles in the corner element 261, two tie rods lying at right angles to each other may also be provided, which are connected to each other by means of a corresponding corner piece. This corner piece could already be provided in the modular unit 261, so that the corresponding tie rods can subsequently be inserted in corresponding recesses and screwed into this corner element.

If the design represented in FIG. 44 is imagined turned through 90° clockwise, the modular unit 261 forms and upper cornice and the two modular units 196 form the side wall and the cover plate of a tiled stove. The same design provided for the horizontal bracing may then also be used for the bracing in vertical direction and for the bracing at the transition from the vertical to the horizontal.

Consequently, the element structure according to FIGS. 42 and 43 may also be a ceiling structure, in which case the props 258 then form supports of the ceiling structure and are arranged in lying position. The spandrels 259 may then form a ceiling cover. Finally, instead of the props 258, columns or frames may be provided. As FIGS. 42 and 43 further show, the modular units form a system which is closed in each direction, in other words upward, downward and to the sides.

Figure 46:
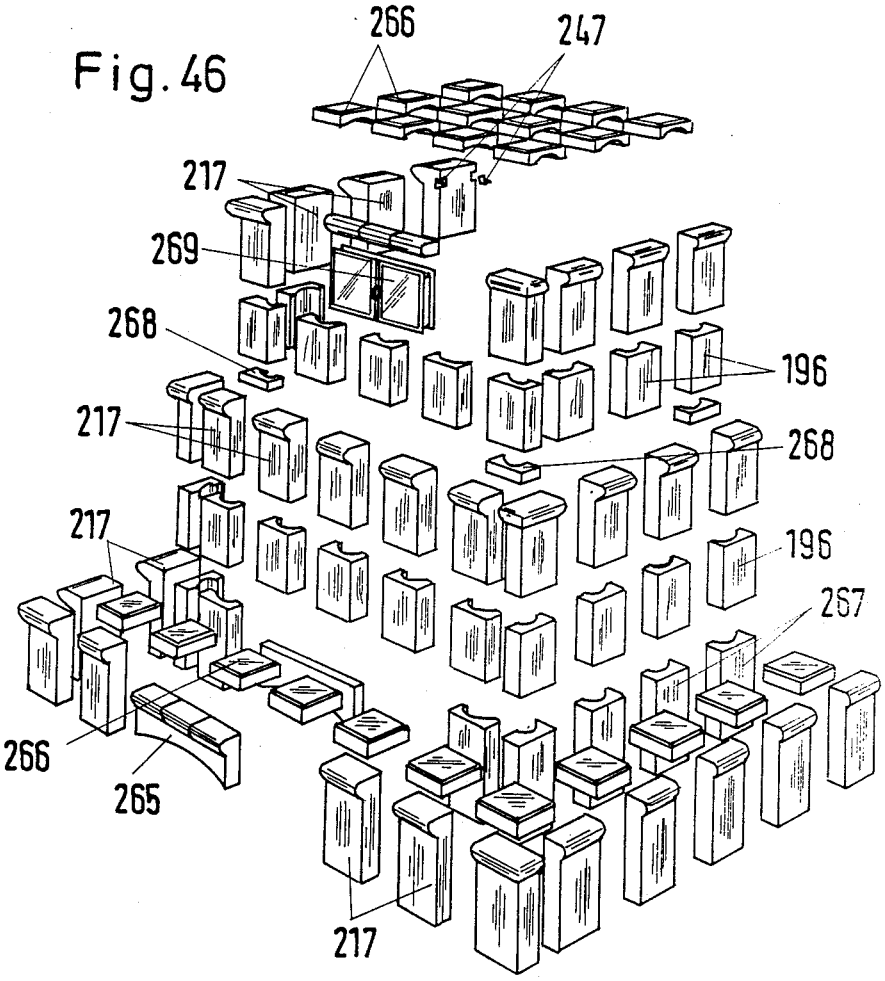

FIG. 45 shows a tiled stove assembled from the modular units described, whose individual parts are represented in FIG. 46. The tiled stove has a step-like design with a base part 262, a middle part 263 and an upper part 264. The base part 262 is essentially formed from the modular units 217 according to FIGS. 38 to 40, which are horizontally braced alongside one another. In front there is additionally provided a base arch 265, which has horizontal through-openings (not shown) for the tie rods 32, 48, so that it can be horizontally braced with the other modular units in the same way as the modular units 217. The modular units 217 of the base part 262 are each provided with the angle pieces 235, which protrude beyond the rear 237 by their horizontal legs 243 (FIG. 39). Supported on these legs 243 are cover plates 266, which are firmly connected to the modular units 217 by means of threaded bolts (not shown) or the like, which are screwed into the threaded bores 244 of the legs 243 of the angle pieces 235. Behind the modular units 217 of the base part 262 are arranged further modular units 267, which have the same height as the modular units 217. They are substantially of the same design as the modular units 196, but longer than the latter. These modular units 267 are also horizontally braced alongside one another. They serve at the same time as a rest for the modular units 196 of the middle part 263. On these modular units 196 are the modular units 217. The modular nits 267, 196 and 217 are assembled in the way described by the vertical bracing to form individual modular elements, which are then horizontally braced among one another.

The modular units 217 of the middle part 263 are in turn provided at the rear with the angle pieces 235, on whose backward-protruding legs 243 leveling pieces 268, with threaded bolts or the like are fixed. They have the same basic outline as the modular units 196 of the top part 264 mounted on them. In this embodiment, leveling pieces 268 are provided only in the region of the corners of the middle part 263, because the modular units 196 lying above there are horizontally braced with each other. For this reason, no separate leveling pieces need be provided for the modular units 196 in the region between the leveling pieces 268. The leveling pieces 268 are high enough for their upper side to lie flush with the upper face 205 of the modular units 196.

The upper part 264 has the horizontally adjacent modular units 196, which are vertically braced with the modular units 217 located above them in each case and, in the corner region, also with the leveling pieces 268, in the way described, to form modular elements. The individual modular elements are then horizontally braced alongside one another in the way described. Between the modular units 217 of the upper part 264 there is additionally a pipe door 269.

The modular units 217 of the upper part 264 have the angle pieces 235 (FIG. 39) on which the edge cover plates 266 are supported and fixed. They have the same design as the cover plates 266 of the base part 262. The cover plates 266 of the upper part 264 are braced with each other in one direction by the tensioning elements according to FIG. 28 and in the other direction by the tie rods to the modular elements.

The tiled stove described consists of only a few different modular units and can easily be assembled. Using the modular units, tiled stoves in the widest variety of configurations can be produced. Owing to the bracings in vertical and horizontal direction, the tiled stoves have a very high stability.

Figure 47:
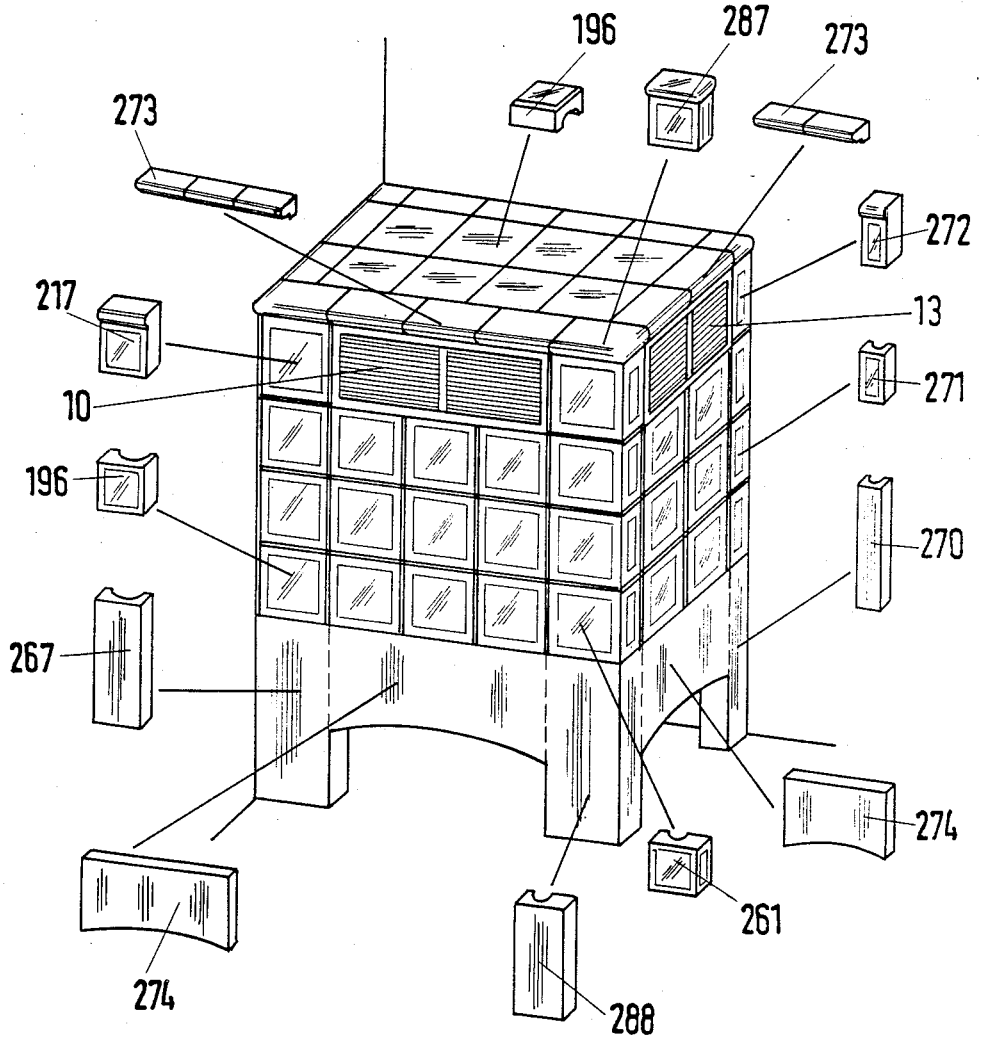

FIG. 47 shows a corner tiled stove which is assembled from the modular units 196, 267, 217, 261, 287, 289, 270 and the base arches 274. The modular units 270 are basically of the same design as the modular units 267, but are only half as wide. The modular units 271 have basically the same design as the modular units 196, but again are only half as wide as the latter. The same also applies to the modular units 272, which are substantially of the same design as the modular units 217, but only have half their width. Above the pipe door 10 and the front door 13 are arranged the modular elements 273 which form the cornice lintel and which are horizontally braced with the neighboring modular units 217. It is also the case with this tiled stove that the modular units mounted one on top of the other are first vertically braced, forming modular elements. They are then set one alongside the other and horizontally braced in the way described. In the case of this embodiment as well, only a few different modular units are necessary to assemble the tiled stove. Owing to the small number of different modular units, stock keeping is simplified and made cheaper. Production is also inexpensive as only a few molds are required for production of the modular units.

The modular unit 246, which forms a base, may for example be a cast element which is preferably produced from chamotte material. It may be provided on the outside with, for example, a plaster layer 275 (FIG. 49).

In the case of the described tiled stoves according to FIGS. 45 to 47, the base arch 265, 274 is designed in one piece. However, the base arch may advantageously also be made up of several modular units, so that two-tiled, three-tiled or four-tiled modular units are produced.

The same also applies to the modular elements 273, which are designed in one piece according to FIG. 48. These modular elements 273 may, advantageously, likewise be made up from modular units to form modular elements, which then can be braced with a tie rod just like the base arch.

Figure 50:
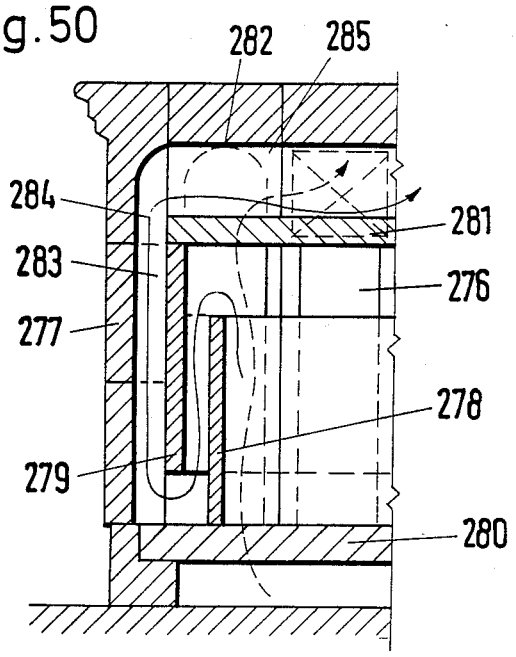
Figure 51:
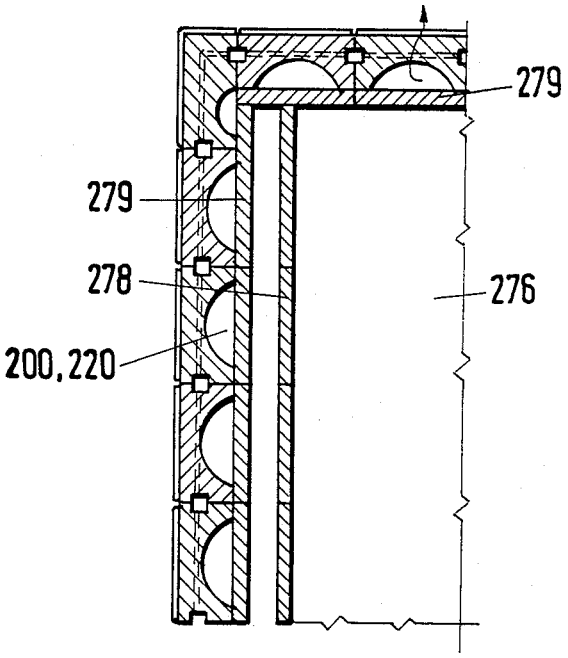

FIGS. 50 and 51 show a tiled stove which is designed as a combined basic and convection stove. The tiled stove has a firebox 276, which is spaced from the outside wall 277 of the tiled stove by two mutually overlapping wall parts 278, 279, which extend over the entire width of the firebox. The wall part 278 stands vertically on a bottom 280 of the firebox 276, while the wall part 279 projects vertically downward from a ceiling part 281. The latter lies at a distance underneath the cover 282 of the tiled stove. The wall parts 278, 279, together with the outside wall 277, form a meander-shaped exhaust gas duct 283. The exhaust gas flow out of the firebox 276 in the direction of the broken arrow 284 through the exhaust gas duct 283. The wall part 279 adjoins the rears of the modular elements (FIG. 51), so that the depressions 200, 220 in the rears of the modular elements, together with the wall part 279, form channels running along the inner side of the outside wall 277, through which the exhaust gases flow upward. The wall part 279 ends at a distance from the bottom 280, so that the exhaust gases can pass into all depressions 200 and 220. The ceiling part 281, together with the cover 282, forms a horizontal exhaust gas channel 285, into which pass upward-flowing exhaust gases from the channels 200, 220. From the exhaust gas channel 285, the exhaust gases then enter an exhaust gas pipe (not shown). The wall part 279, which may be provided on all inner sides of the tiled stove, may consist for example of chamotte, sheet metal or the like. The exhaust gases flowing through the channels 200, 220 and 285 heat the inner tile walling. The room air can enter the tiled stove from below. It is warmed on the inside of the tile walling and leaves the tiled stove in the upper region, as indicated by broken lines in FIGS. 51 and 52.

The modular elements described can be used to assemble element structures. These modular elements can be used to assemble constructions of any kind, e.g., buildings, furniture, machines, housings or the like. The modular elements themselves may consist of varying materials, e.g. casting compounds, wood, stone, metal, chamotte or the like. If the molding elements are used for tiled stoves, they may also be formed into complete tiles from granulated tile material.

What is claimed is:

1. A process for the erection of a structure made of prefabricated modular elements, comprising the steps of:

(a) providing prefabricated modular elements of appropriate configurations and sizes, each modular element containing a tensioning element positioned therein to be concealed from viewing upon assembly of the structure;

(b) provide tightening members and coupling pieces to cooperatively apply tension to the tensioning elements as the structure is assembled and, thereby, to relieve the modular elements from tension;

(c) placing the coupling pieces on the tightening members, the tightening members being positioned to fit between the tensioning elements;

(d) erecting the structure by individually placing the modular elements against each other in abutting relationship, the placing of each modular elements being determined by the configuration of the structure to be assembled;

(e) continually placing the tensioning elements under tension as the structure is assembled, the tensioning elements cooperating with the tightening members and coupling pieces positioned between the tensioning elements to provide said tension;

(f) creating openings within the structure exactly sized to received each modular element, including a final modular element, said openings remaining constant in size regardless of expansion or shrinking of the modular elements or the tensioning elements; and (g) inserting the final modular element into position in the structure from any open side of the last opening.

2. The process according to claim 1, characterized in that each modular element is capable of being removed from the opening by releasing the coupling pieces or being tightened after fitting into the final opening at any desired point within the element construction, without the surrounding modular elements having to be changed or displaced.

3. The process according to claim 1, characterized in that any desired modular element is capable of being used as a terminal element.

4. The process according to claim 1, characterized in that the tightening members are braced through a joint axis formed by the connection between two aligned tensioning elements.

5. A modular structure, comprising:

prefabricated modular elements positioned in abutting relationship with each other to define the exterior configuration of the structure;

tensioning elements for receiving and transmitting tension forces within the structure and thereby relieving the modular elements from tension, each modular element having a tensioning element therein, the tensioning elements being concealed from view when the modular elements are positioned within the structure; and tightening members and coupling pieces cooperating with the tensioning elements to effect said tensioning, the coupling pieces bracing the tightening members to each other, the coupling pieces being arranged in the modular element before the associated modular elements are fitted into the structure;

wherein, the structure, as a result of the tightening members, retains its configuration as modular elements are added thereto, the tensioning of the structure being transferred to the tensioning elements, the structure having an exactly fitting opening for insertion of the last modular element therein from any open side of the last opening.

6. An element structure according to claim 5, characterized in that each modular element is capable of being removed from its space by releasing of the coupling pieces or of being braced after fitting into the opening at any desired point within the element construction, without the surrounding modular elements having to be changed or displaced.

7. An element structure according to claim 5, characterized in that the tightening members are designed symmetrically with respect to their transverse center axis.

8. An element structure according to claim 5, characterized in that the tightening members are capable of being stressed, preferably pretensioned, through joints, preferably through the joint axis, between neighboring modular elements.

9. An element structure according to claim 5, characterized in that there are seated on the ends of the tightening members counter coupling pieces displaceable against spring force and capable of being connected to one another by the coupling pieces, said counter coupling pieces receiving springs which surround the tightening member ends and bear against a bottom of the counter coupling pieces and against a stop of the tightening member ends.

10. An element structure according to claim 9, characterized in that the counter coupling pieces are sleeves.

11. An element structure according to claim 9, characterized in that the counter coupling pieces are designed so that they are rotationally adjustable and axially fixed with respect to the tightening members.

12. An element structure according to claim 9, characterized in that the counter coupling pieces are displaceable in the aerial direction of the tightening members.

13. An element structure according to claim 9, characterized in that the counter coupling pieces are, with preassembled modular elements, aligned centrally on the tightening members.

14. An element structure according to claim 13, characterized in that the counter coupling pieces are centered by said flexibly complaint component.

15. An element structure according to claim 5, characterized in that the tightening members of the modular elements are arranged to cross one another.

16. An element structure according to claim 5, characterized in that the tightening member runs angled-off in a modular element which is designed as a corner element and has two side walls lying at an angle to each other for the connection to further modular elements lying at an angle to each other.

17. An element structure according to claim 5, characterized in that at least some of the modular elements are designed in one piece with a base part.

18. An element structure according to claim 5, characterized in that at least some of the modular elements are provided at the rear with a bearing surface on which the modular elements can be placed.

19. An element structure according to claim 5, characterized in that one of the modular elements has on its lower face at least one interlocking part, to which at least one counter interlocking part is assigned in an upper face of a neighboring modular element.

20. An element structure according to claim 5, characterized in that the tension element is connected by its end to a holding part in one of the modular elements with the stressing device and is supported, preferably prestressed, by a stressing element, with at least one compression spring interposed against a stop of one of the modular elements.

21. An element structure according to claim 20, characterized in that the holding part lies in a recess of the side wall of the modular element, which recess is accessible from the front or rear of the modular element.

22. An element structure according to claim 20, characterized in that the holding part has a threaded bore into which the one end of the tension rod is screwed.

23. An element structure according to claim 20, characterized in that the stressing element lies in an outwardly open recess, one wall of which preferably forms the stop.

24. An element structure according to claim 20, characterized in that the modular element is provided on its rear with at least one bearing which is fixed in a recess of the modular element and protrudes beyond said rear.

25. An element structure according to claim 24, characterized in that the bearing is fixed on the neighboring holding part of the modular element.

26. An element structure according to claim 5, further including a fire space, from which at least one waste gas duct runs, said fire space running at least over a part of its length along at least a part of the inner side of one side of the element structure.

27. An element structure according to claim 26, characterized in that the waste gas duct is bounded by a depression provided on the rear of the modular elements, and a wall part being connected to the rear of the modular elements.

28. An element structure according to claim 5, characterized in that the tightening members are non-rotatable in the modular elements.

29. An element structure according to claim 5, characterized in that the difference in the thermal expansion between the modular elements and said stressing device is compensated by flexibly compliant components.

30. An element structure according to claim 29, characterized in that the flexibly compliant component is formed by at least one compression spring.

* * * * *